US010775714B2

(12) United States Patent
Shiomi et al.

(10) Patent No.: US 10,775,714 B2
(45) Date of Patent: Sep. 15, 2020

(54) DEVELOPING DEVICE

(71) Applicant: CANON KABUSHIKI KAISHA, Tokyo (JP)

(72) Inventors: Tomohiro Shiomi, Abiko (JP); Teruaki Tsurusaki, Moriya (JP); Shunichi Koga, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/685,973

(22) Filed: Nov. 15, 2019

(65) Prior Publication Data

US 2020/0166868 A1 May 28, 2020

(30) Foreign Application Priority Data

Nov. 27, 2018 (JP) ..... 2018-220915

(51) Int. Cl.
*G03G 15/08* (2006.01)
*G03G 21/16* (2006.01)

(52) U.S. Cl.
CPC ..... *G03G 15/0812* (2013.01); *G03G 15/0891* (2013.01); *G03G 21/1647* (2013.01); *G03G 2215/0861* (2013.01)

(58) Field of Classification Search
CPC ..... G03G 15/0812
See application file for complete search history.

(56) References Cited

U.S. PATENT DOCUMENTS

2016/0139535 A1* 5/2016 Yasui ..... G03G 21/181 399/260
2018/0031999 A1* 2/2018 Ogawa ..... G03G 15/0812
2018/0032000 A1* 2/2018 Shinkawa ..... G03G 15/0812
2018/0341193 A1* 11/2018 Tsurusaki ..... G03G 15/0812
2019/0171131 A1* 6/2019 Koga ..... G03G 15/0812

FOREIGN PATENT DOCUMENTS

JP 2008224904 A 9/2008
JP 2009086386 A 4/2009
JP 2014197175 A 10/2014

* cited by examiner

*Primary Examiner* — Thomas S Giampaolo, II
(74) *Attorney, Agent, or Firm* — Canon U.S.A., Inc. IP Division

(57) ABSTRACT

There is provided a developing device including, when viewed in a section perpendicular to a rotational axis of a rotatable developing member, a recessed portion to grip a resin-made regulating blade formed on an upstream side of the regulating blade with respect to a closest position where the regulating blade comes closest to the rotatable developing member in a rotation direction of the rotatable developing member, and a vertical length of the recessed portion in a direction vertical to a straight line passing through the closest position and a rotation center of the rotatable developing member is 0.5 mm or more.

10 Claims, 17 Drawing Sheets

DEVELOPING DEVICE

BACKGROUND OF THE DISCLOSURE

Field of the Disclosure

The present disclosure relates to a developing device including a resin-made regulating blade.

Description of the Related Art

A developing device includes a developing device frame, a rotatable developer bearing member that bears developer for developing an electrostatic latent image formed on an image bearing member, and a regulating blade serving as a developer regulating member for regulating an amount of the developer born on the developer bearing member. The regulating blade is provided opposing the developer bearing member with a predetermined gap (hereinafter, referred to as an SB gap) interposed between the regulating blade and the developer bearing member along a rotational axis direction of the developer bearing member. The SB gap refers to a shortest distance between the developer bearing member and the regulating blade. The amount of the developer conveyed to a developing region where the developer bearing member faces the image bearing member is adjusted by adjusting the size of the SB gap.

A developing device including a resin-made developer regulating member molded from resin and a resin-made developing device frame molded from resin has recently been known (see Japanese Patent Application Laid-Open No. 2014-197175).

A developing device including a resin-made regulating blade and a resin-made developing device frame may have a structure in which the resin-made regulating blade is mounted and fixed onto a blade mounting portion of the resin-made developing device frame.

A length of a region in a longitudinal direction of the regulating blade (maximum image region of the regulating blade) corresponding to a maximum image region in an image region that can be formed on the image bearing member increases as a width of a sheet on which an image is formed increases. In addition, a length in the longitudinal direction of a surface on which the regulating blade is mounted (the surface is hereinafter referred to as a blade mounting surface) of the blade mounting portion of the developing device frame increases as the length in the longitudinal direction of the maximum image region of the regulating blade increases.

If the developing device frame with a long length in the longitudinal direction of the blade mounting surface of the developing device frame is molded from resin, unevenness of the blade mounting surface of the developing device frame is more likely to increase, so that the flatness (Japanese Industrial Standards (JIS) B0021) of the blade mounting surface of the developing device frame is liable to increase. This is because, in general, a variation in flatness in the longitudinal direction of a resin molded product is liable to occur as the length in the longitudinal direction of the resin molded product increases.

In the case of mounting and fixing the regulating blade onto the blade mounting surface of the developing device frame, an orientation of the developing device frame is converted so as to make the blade mounting surface of the developing device frame substantially parallel to an installation surface (horizontal surface) of a mounting device of the regulating blade, and the developing device frame is installed in the mounting device of the regulating blade. In this case, the inclination of the blade mounting surface of the developing device frame with respect to the installation surface (horizontal surface) of the mounting device of the regulating blade tends to be greater when the flatness of the blade mounting surface is large than when the flatness of the blade mounting surface is small. In addition, there is a possibility that the position of the regulating blade relative to a developing sleeve when the regulating blade is mounted on the blade mounting surface may vary as the inclination of the blade mounting surface with respect to the installation surface (horizontal surface) of the mounting device of the regulating blade increases. The position of the regulating blade relative to the developing sleeve includes a position where the regulating blade comes closest to the developing sleeve.

On the other hand, the size of the SB gap in a state where the regulating blade is fixed to the blade mounting surface is more likely to vary in the longitudinal direction of the developing sleeve as the amount of variation in the position of the regulating blade relative to the developing sleeve when the regulating blade is mounted on the blade mounting surface increases. Further, if the size of the SB gap varies in the longitudinal direction of the developing sleeve, there is a possibility that unevenness may occur in the amount of the developer to be born on the surface of the developing sleeve in the longitudinal direction of the developing sleeve.

Accordingly, there is a demand for preventing a variation in the position of the regulating blade relative to the developing sleeve, including the position where the regulating blade comes closest to the developing sleeve, when the regulating blade is mounted on the blade mounting surface, regardless of the flatness of the blade mounting surface of the developing device frame.

SUMMARY OF THE DISCLOSURE

The present disclosure is directed to a developing device capable of preventing a variation in a position where a resin-made regulating blade comes closest to a rotatable developing member when the regulating blade is mounted on a resin-made developing device frame.

According to an aspect of the present disclosure, a developing device includes a rotatable developing member configured to bear and feed a developer including toner and carrier toward a position where an electrostatic image formed on an image bearing member is developed. A resin-made regulating blade is provided opposing the rotatable developing member and configured to regulate an amount of the developer born on the rotatable developing member, and a resin-made developing device frame provided separately from the regulating blade and including a mounting portion to mount the regulating blade. A recessed portion for gripping the regulating blade is formed, when the developing device is viewed in a section perpendicular to a rotational axis of the rotatable developing member, on an upstream side of the regulating blade with respect to a closest position where the regulating blade is closest to the rotatable developing member in a rotation direction of the rotatable developing member, and wherein a length of the recessed portion in a direction vertical to a straight line passing through the closest position and a rotation center of the rotatable developing member is 0.5 mm or more.

Further features and aspects of the present disclosure will become apparent from the following description of example embodiments with reference to the attached drawings.

DESCRIPTION OF THE EMBODIMENTS

Example embodiments, features and various aspects of the present disclosure will be descried in detail below with reference to the accompanying drawings. The following example embodiments are not intended to limit the present disclosure described in the claims, and not all combinations of features described in the following example embodiments are essential to the solving means of the present disclosure. The present disclosure can be implemented in various applications such as a printer, various printing machines, a copying machine, a facsimile (FAX) machine, and a multifunction peripheral.

<Example Structure of Image Forming Apparatus>

Figure 1:
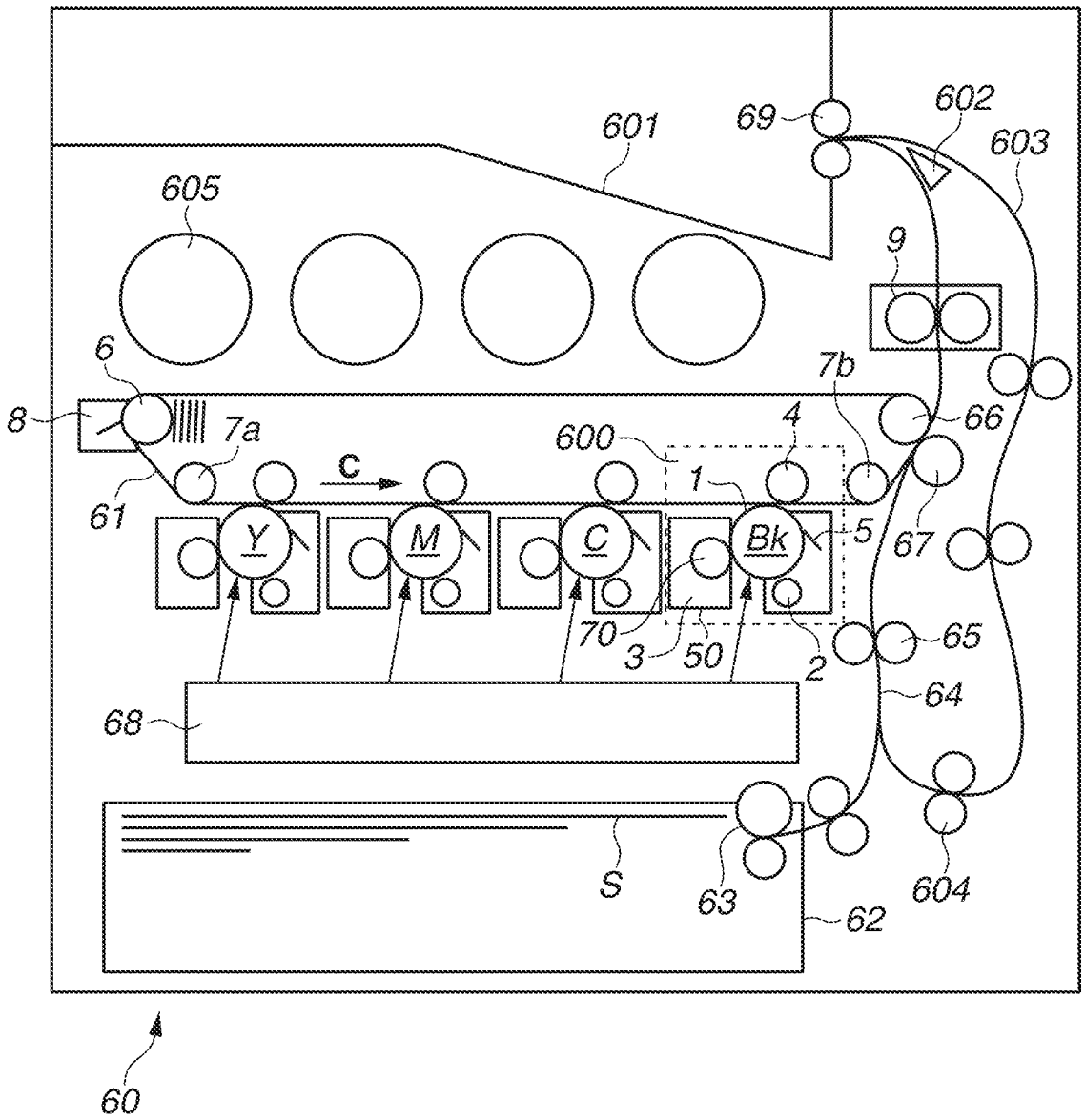
FIG. 1 is a sectional view illustrating a structure of an image forming apparatus according to a first example embodiment.

First, a structure of an image forming apparatus according to a first example embodiment of the present disclosure will be described with reference to a sectional view illustrated in FIG. 1. As illustrated in FIG. 1, an image forming apparatus 60 includes an endless intermediate transfer belt 61 as an intermediate transfer member, and four image forming units 600, which are provided in a range from an upstream side to a downstream side along a rotation direction (direction indicated by an arrow C in FIG. 1) of the intermediate transfer belt 61. The image forming units 600 form toner images of yellow (Y), magenta (M), cyan (C), and black (Bk), respectively.

Each image forming unit 600 includes a rotatable photosensitive drum 1 as an image bearing member. Each image forming unit 600 also includes a charging roller 2 as a charging unit, a developing device 3 as a developing unit, a primary transfer roller 4 as a primary transfer unit, and a photosensitive drum cleaner 5 as a photosensitive drum cleaning unit, which are disposed along a rotation direction of the photosensitive drum 1.

Each developing device 3 is attachable to and detachable from the image forming apparatus 60. Each developing device 3 includes a developer container 50 that contains two-component developer (hereinafter simply referred to as developer) including a nonmagnetic toner (hereinafter simply referred to as toner) and a magnetic carrier. Toner cartridges containing toner of Y, M, C, and Bk, respectively, are attachable to and detachable from the image forming apparatus 60. The toner of each of Y, M, C, and Bk is supplied to the corresponding developer container 50 through a toner conveyance path. The developing device 3 will be described in detail below with reference to FIGS. 2 to 4, and the developer container 50 will be described in detail below with reference to FIG. 5.

The intermediate transfer belt 61 is stretched around a tension roller 6, a driven roller 7*a*, the primary transfer roller 4, a driven roller 7*b*, and a secondary inner transfer roller 66, and is moved in the direction indicated by the arrow C in FIG. 1. The secondary inner transfer roller 66 also functions as a drive roller that drives the intermediate transfer belt 61. The intermediate transfer belt 61 is rotated in the direction indicated by the arrow C in FIG. 1 along with the rotation of the secondary inner transfer roller 66.

The intermediate transfer belt 61 is pressed by the primary transfer roller 4 from a back surface of the intermediate transfer belt 61. The intermediate transfer belt 61 is brought into contact with the photosensitive drum 1, thereby forming a primary transfer nip portion as a primary transfer portion between the photosensitive drum 1 and the intermediate transfer belt 61.

An intermediate transfer member cleaner 8 serving as a belt cleaning unit contacts the intermediate transfer belt 61 at a position opposing the tension roller 6 via the intermediate transfer belt 61. A secondary outer transfer roller 67 serving as a secondary transfer unit is disposed at a position opposing the secondary inner transfer roller 66 via the intermediate transfer belt 61. The intermediate transfer belt 61 is nipped between the secondary inner transfer roller 66 and the secondary outer transfer roller 67. In this way, a secondary transfer nip portion serving as a secondary transfer portion is formed between the secondary outer transfer roller 67 and the intermediate transfer belt 61. In the secondary transfer nip portion, a toner image is adsorbed on a surface of a sheet S (e.g., paper or a film) by applying a predetermined pressing force and a transfer bias (electrostatic load bias).

Sheets S are stored in a sheet storage portion 62 (e.g., a sheet feed cassette or a sheet feed deck) in a stacked state. A sheet feed unit 63 feeds a sheet S at an image formation timing using, for example, a frictional separation method including a sheet feed roller. The sheet S fed by the sheet feed unit 63 is conveyed to registration rollers 65 disposed in the middle of a conveyance path 64. After the registration rollers 65 perform a skew correction or a timing correction, the sheet S is conveyed to the secondary transfer nip portion. In the secondary transfer nip portion, a secondary transfer operation is performed in a matched state of the timing of the sheet S and the timing of the toner image.

A fixing device 9 is disposed on a downstream side of the secondary transfer nip portion in a conveyance direction of the sheet S. A predetermined pressure and a predetermined amount of heat are applied from the fixing device 9 to the sheet S conveyed to the fixing device 9, thereby melting and fixing the toner image onto the surface of the sheet S. In this manner, the sheet S having the image fixed thereon is directly discharged to a discharge tray 601 by a forward rotation of discharge rollers 69.

In a case of double-sided image formation, the sheet S is conveyed until a trailing edge of the sheet S passes through a switching flapper 602 by a forward rotation of the discharge rollers 69. Then, the discharge rollers 69 are rotated reversely. As a result, leading and trailing edges of the sheet S are reversed and the sheet S is conveyed to a duplex conveying path 603. After that, the sheet S is conveyed to the conveyance path 64 again by a re-feed roller 604 in synchronization with the next image forming timing.

<Example Image Forming Process>

During image formation, the photosensitive drum 1 is rotationally driven by a motor. The charging roller 2 uniformly charges the surface of the rotationally driven photosensitive drum 1 in advance. An exposure device 68 forms an electrostatic latent image on a surface of the photosensitive drum 1 electrically charged by the charging roller 2 based on an image information signal input to the image forming apparatus 60. The photosensitive drum 1 is capable of forming a plurality of sizes of electrostatic latent images.

The developing device 3 includes a rotatable developing sleeve 70 as a developer bearing member that bears the developer. The developing device 3 develops the electrostatic latent image formed on the surface of the photosensitive drum 1 by using the developer born on the surface of the developing sleeve 70. As a result, the toner is attached to an exposure portion on the surface of the photosensitive drum 1 to thereby form a visible image. A transfer bias (electrostatic load bias) is applied to the primary transfer roller 4 to transfer the toner image formed on the surface of the photosensitive drum 1 onto the intermediate transfer belt 61. A small amount of the toner remaining on the surface of the photosensitive drum 1 after the primary transfer (transfer residual toner) is collected by the photosensitive drum cleaner 5, to thereby prepare for the next image forming process again.

Image formation processes for the respective colors performed by parallel processing using the image forming units 600 for the respective colors of Y, M, C, and Bk are carried out at a timing when the images are sequentially superimposed on the toner image having an upstream color primarily transferred onto the intermediate transfer belt 61. As a result, a full-color toner image is formed on the intermediate transfer belt 61, and the toner image is conveyed to the secondary transfer nip portion. A transfer bias is applied to the secondary outer transfer roller 67, and the toner image formed on the intermediate transfer belt 61 is transferred onto the sheet S conveyed to the secondary transfer nip portion. A small amount of the toner remaining on the intermediate transfer belt 61 after the sheet S passes through the secondary transfer nip portion (transfer residual toner) is collected by the intermediate transfer member cleaner 8. The fixing device 9 fixes the toner image transferred onto the sheet S. The sheet S subjected to the fixing process by the fixing device 9 is discharged onto the discharge tray 601.

A series of image forming processes described above is completed to prepare for the next image forming operation.

<Example Structure of Developing Device>

Figure 2:
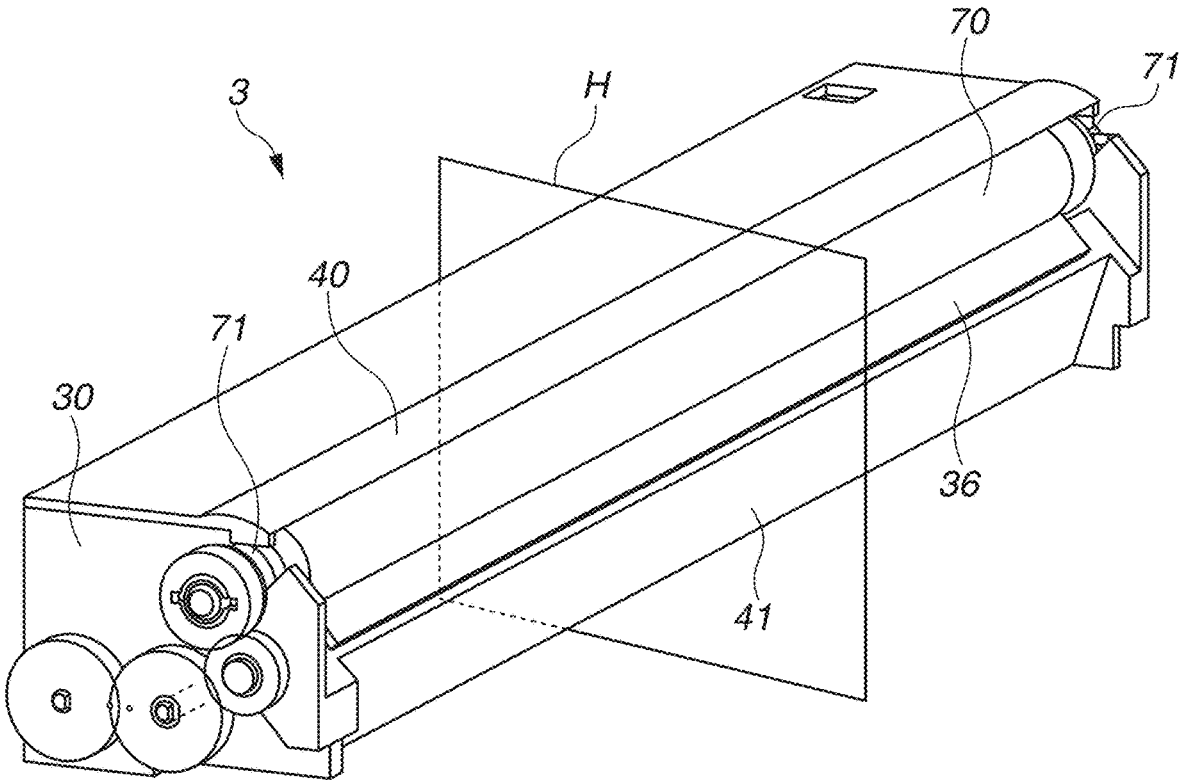
FIG. 2 is a perspective view illustrating an example structure of a developing device.
Figure 3:
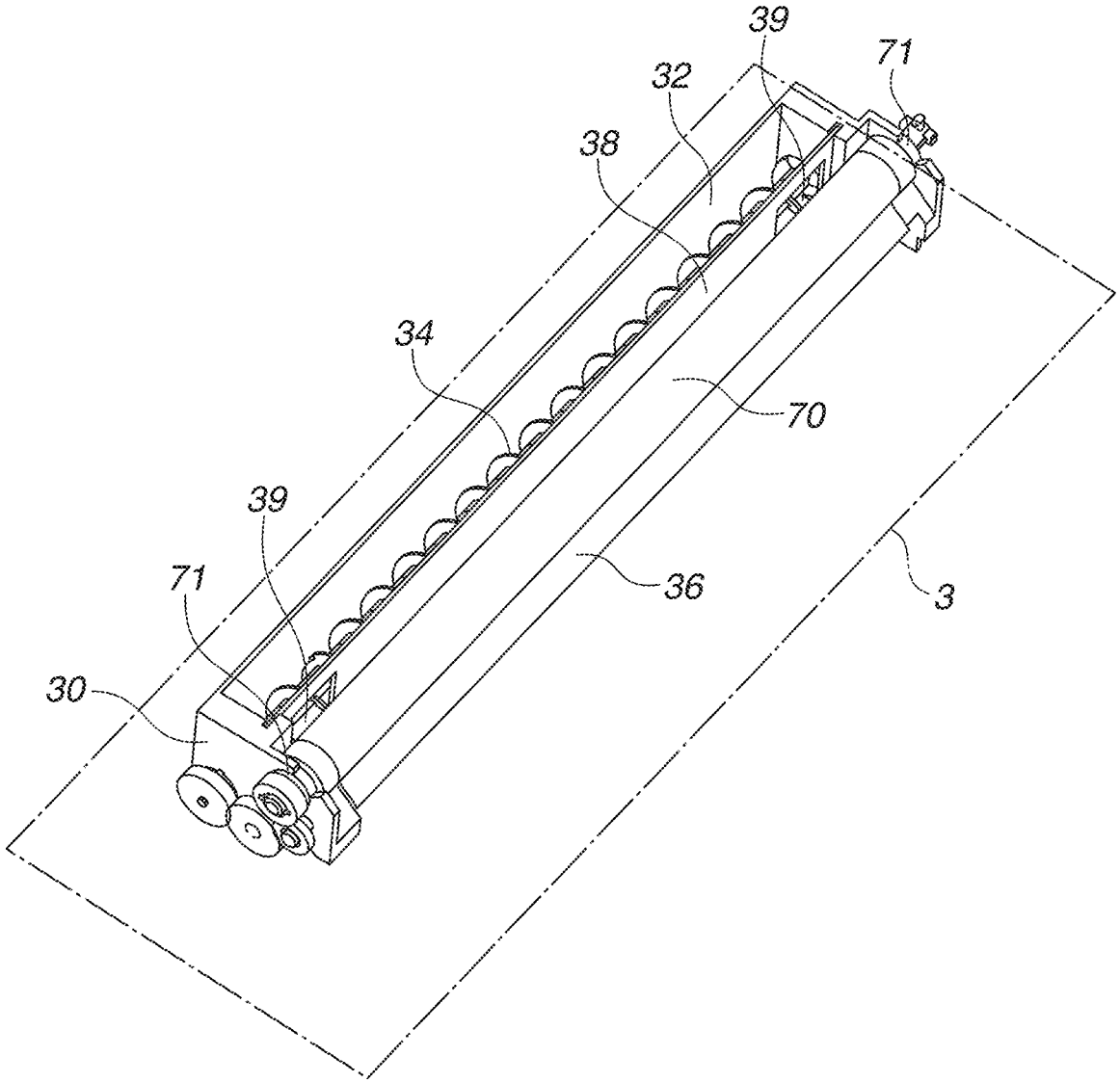
FIG. 3 is a perspective view illustrating the structure of the developing device.
Figure 4:
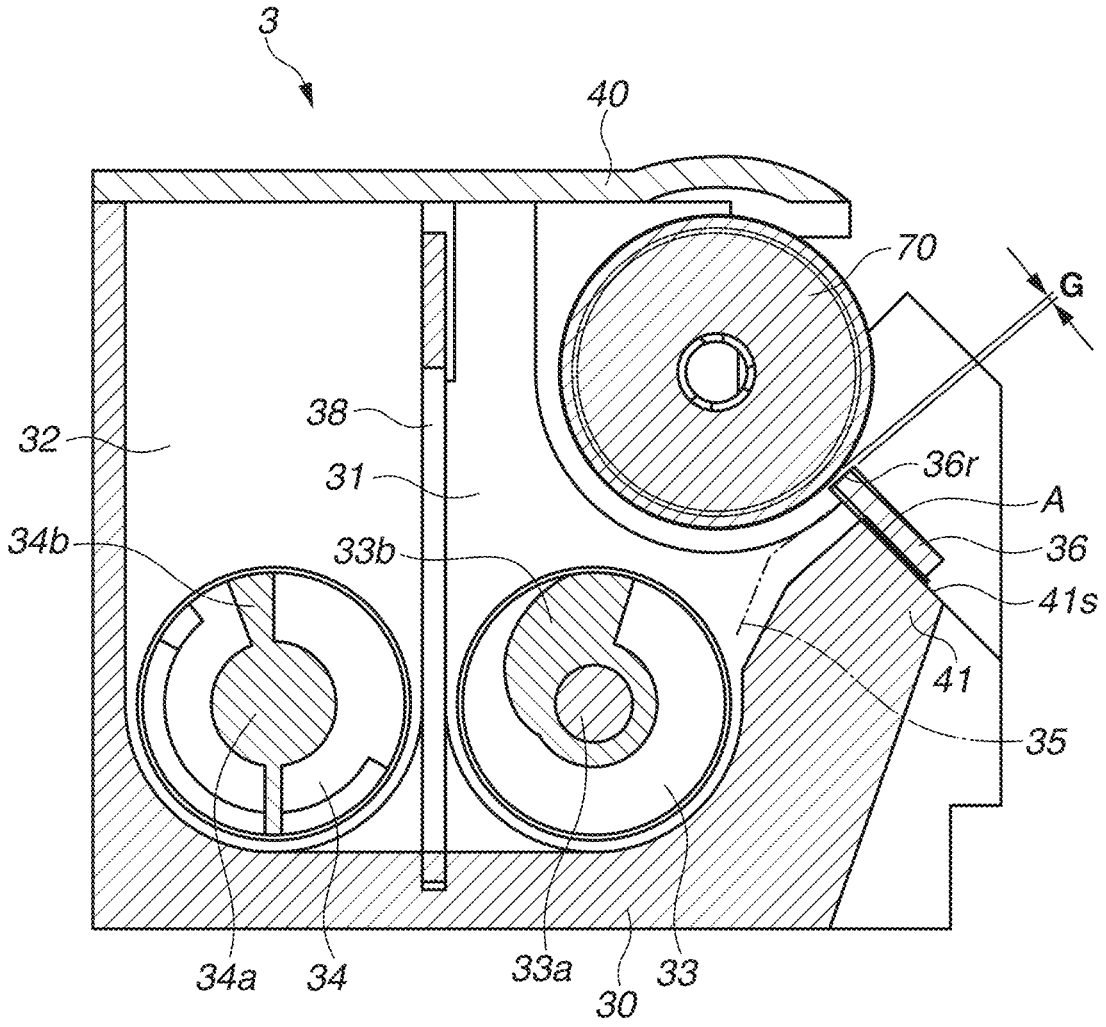
FIG. 4 is a sectional view illustrating the structure of the developing device.

A general structure of a developing device will be described with reference to a perspective view illustrated in FIG. 2, a perspective view illustrated in FIG. 3, and a sectional view illustrated in FIG. 4. FIG. 4 is a sectional view of the developing device 3 taken along a section H illustrated in FIG. 2.

The developing device 3 includes a resin-made developing device frame molded from resin (hereinafter simply referred to as developing device frame 30), and the developer container 50 formed of resin-made cover frame 40 (hereinafter, simply referred to cover frame 40) that is formed separately from the developing device frame 30 from resin. FIGS. 2 and 4 each illustrate a state where a cover frame 40 is mounted on the developing device frame 30. FIG. 3 illustrates a state where the cover frame 40 is not mounted on the developing device frame 30. The structure of the developing device frame 30 (alone) will be described in detail below with reference to FIG. 6.

The developer container 50 is provided with an opening at a position corresponding to a developing region where the developing sleeve 70 faces the photosensitive drum 1. The developing sleeve 70 is disposed rotatably with respect to the developer container 50 so that a part of the developing sleeve 70 is exposed at the opening of the developer container 50. Bearings 71, which are bearing members, are respectively provided at both ends of the developing sleeve 70.

The inside of the developer container 50 is divided (partitioned) into a developing chamber 31 as a first chamber and a stirring chamber 32 as a second chamber by a vertically extending partition wall 38. The developing chamber 31 and the stirring chamber 32 are connected to each other at both longitudinal ends through two communicating portions 39 of the partition wall 38. Accordingly, the developer can communicate between the developing chamber 31 and the stirring chamber 32 through the communicating portions 39. The developing chamber 31 and the stirring chamber 32 are arranged side by side (at right and left sides) in a horizontal direction.

A plurality of magnetic poles is provided along a rotation direction of the developing sleeve 70 in the developing sleeve 70. A magnet roll serving as a magnetic field generation unit, which generates a magnetic field for bearing the developer on the surface of the developing sleeve 70, is disposed in a fixed manner. The developer in the developing chamber 31 is scooped up by the influence of the magnetic field of the magnetic pole of the magnetic roll, and is supplied to the developing sleeve 70. Since the developer is supplied from the developing chamber 31 to the developing sleeve 70, the developing chamber 31 is also referred to as a supply chamber.

In the developing chamber 31, a first conveyance screw 33 serving as a conveyance unit for stirring and conveying the developer in the developing chamber 31 is provided opposing the developing sleeve 70. The first conveyance screw 33 includes a rotational shaft 33*a* as a rotatable shaft portion and a helical blade portion 33*b* as a developer conveying portion provided along an outer periphery of the rotational shaft 33*a*, and is supported rotatably relative to the developer container 50. Bearing members are respectively provided at both end portions of the rotational shaft 33*a*.

The stirring chamber 32 is provided with a second conveyance screw 34 as a conveyance unit for stirring the developer in the stirring chamber 32 and conveying the developer in a direction opposite to a developer conveyance direction of the first conveyance screw 33. The second conveyance screw 34 includes a rotary shaft 34*a* as a rotatable shaft portion and a helical blade portion 34*b* as a developer conveying portion provided along an outer periphery of the rotary shaft 34*a*, and is rotatably supported relative to the developer container 50. Bearing members are respectively provided at both end portions of the rotary shaft 34*a*. The first conveyance screw 33 and the second conveyance screw 34 are rotationally driven, thereby forming a circulating path in which the developer is circulated between the developing chamber 31 and the stirring chamber 32 through the communicating portions 39.

A regulating blade (hereinafter referred to as a doctor blade 36) as a developer regulating member for regulating an amount of the developer (also referred to as a developer coating amount) born on the surface of the developing sleeve 70 is attached to the developer container 50 in such a manner that the regulating blade opposes the surface of the developing sleeve 70 without being in contact with the surface of the developing sleeve 70. The doctor blade 36 includes a coating amount regulating surface 36*r* as a regulating portion for regulating the amount of the developer born on the surface of the developing sleeve 70. The doctor blade 36 is a resin-made doctor blade molded from resin. The structure of the doctor blade 36 (alone) will be described below with reference to FIG. 5.

The doctor blade 36 is provided opposing the developing sleeve 70 via a predetermined gap (hereinafter referred to as an SB gap G) interposed between the doctor blade 36 and the developing sleeve 70 in the longitudinal direction of the developing sleeve 70 (i.e., a rotational axis direction of the developing sleeve 70). Assume herein that the SB gap G is a minimum distance between a maximum image region of the developing sleeve 70 and a maximum image region of the doctor blade 36. The maximum image region of the developing sleeve 70 refers to a region of the developing sleeve 70 corresponding to a maximum image region in an image region in which an image can be formed on the surface of the photosensitive drum 1 in the rotational axis direction of the developing sleeve 70. The maximum image region of the doctor blade 36 refers to a region of the doctor blade 36 corresponding to the maximum image region of the image region in which an image can be formed on the surface of the photosensitive drum 1 in the rotational axis direction of the developing sleeve 70. In the first example embodiment, electrostatic latent images having a plurality of sizes can be formed on the surface of the photosensitive drum 1. Accordingly, the maximum image region refers to an image region corresponding to a largest size (e.g., A3 size) among the plurality of sizes of image regions that can be formed on the surface of the photosensitive drum 1. On the other hand, in a modified example in which an electrostatic latent image having only one size can be formed on the surface of the photosensitive drum 1, the maximum image region indicates an image region having the only one size in which the electrostatic latent image can be formed on the surface of the photosensitive drum 1, instead thereof.

The doctor blade 36 is disposed substantially opposing a peak position of a magnetic flux density of the magnetic pole of the magnet roll. The developer supplied to the developing sleeve 70 is influenced by the magnetic field of the magnetic pole of the magnet roll. Further, the developer regulated and scraped off by the doctor blade 36 tends to stagnate at a portion upstream of the SB gap G. As a result, a developer stagnating portion is formed on the upstream side of the doctor blade 36 in the rotational direction of the developing sleeve 70. Then, a part of the developer stagnating at the developer stagnating portion is conveyed through the SB gap G along with the rotation of the developing sleeve 70. In this case, a layer thickness of the developer passing through the SB gap G is regulated by the coating amount regulating surface 36*r* of the doctor blade 36. In this way, a thin layer of the developer is formed on the surface of the developing sleeve 70.

Then, a predetermined amount of the developer born on the surface of the developing sleeve 70 is conveyed to the developing region along with the rotation of the developing sleeve 70. Therefore, the amount of the developer to be conveyed to the developing region is adjusted by adjusting the size of the SB gap G. In the first example embodiment, when the magnitude of the SB gap G is adjusted, a target size of the SB gap G (i.e., target value of the SB gap G) is set to about 300 μm.

The developer conveyed to the developing region is magnetically raised in the developing region, so that a magnetic brush is formed. The magnetic brush contacts the photosensitive drum 1, thereby supplying the toner in the developer to the photosensitive drum 1. Then, the electrostatic latent image formed on the surface of the photosensitive drum 1 is developed into a toner image. The developer on the surface of the developing sleeve 70 after passing through the developing region and supplying the toner to the photosensitive drum 1 (hereinafter, this developer is referred to as developer obtained after a development process) is scraped off from the surface of the developing sleeve 70 by a repelling magnetic field formed between the identical-polarity magnetic poles of the magnet roll. The developer obtained after the development process, which is scraped off from the surface of the developing sleeve 70, drops into the developing chamber 31, and is collected in the developing chamber 31.

As illustrated in FIG. 4, the developing device frame 30 is provided with a developer guide portion 35 for guiding the developer to be conveyed toward the SB gap G. The developer guide portion 35 and the developing device frame 30 are integrally formed, and the developer guide portion 35 and the doctor blade 36 are formed separately from each other. The developer guide portion 35 is formed inside the developing device frame 30 and is disposed on the upstream side of the coating amount regulating surface 36*r* of the doctor blade 36 in the rotation direction of the developing sleeve 70. A flow of the developer is stabilized by the developer guide portion 35 to adjust the density of the developer to a predetermined developer density, thereby defining the weight of the developer at a position where the coating amount regulating surface 36*r* of the doctor blade 36 comes closest to the surface of the developing sleeve 70.

As illustrated in FIG. 4, the cover frame 40 is formed separately from the developing device frame 30 and is mounted on the developing device frame 30. Further, the cover frame 40 covers a part of an opening of the developing device frame 30 to cover a part of an outer peripheral surface of the developing sleeve 70 over an entire area of the developing sleeve 70 in the longitudinal direction. In this case, the cover frame 40 covers a part of the opening of the developing device frame 30 so that the developing region of the developing sleeve 70 opposing the photosensitive drum 1 is exposed. The cover frame 40 is fixed to the developing device frame 30 by ultrasonic bonding. However, as a method for fixing the developing device frame 30 to the cover frame 40, any one of screw fastening, snap fitting, bonding, welding, and the like may be used. As for the cover frame 40, as illustrated in FIG. 4, the cover frame 40 may be formed using a single part (resin molded product), or may be formed using a plurality of parts (resin molded products).

<Example Structure of Resin-Made Doctor Blade>

The structure of the doctor blade 36 (alone) will be described with reference to a perspective view illustrated in FIG. 5.

During an image forming operation (development operation), the pressure of the developer generated from a flow of the developer (hereinafter, this pressure is referred to as a developer pressure) is exerted on the doctor blade 36. As the rigidity of the doctor blade 36 decreases, the doctor blade 36 is more likely to be deformed and the size of the SB gap G is more likely to vary when the developer pressure is exerted on the doctor blade 36 during the image forming operation. During the image forming operation, the developer pressure is applied in a widthwise direction (direction indicated by an arrow M in FIG. 5) of the doctor blade 36. Accordingly, in order to prevent a variation in the size of the SB gap G during the image forming operation, the doctor blade 36 is desirably made resistant to deformation in the widthwise direction of the doctor blade 36 by increasing the rigidity of the doctor blade 36 in the widthwise direction.

Figure 5:
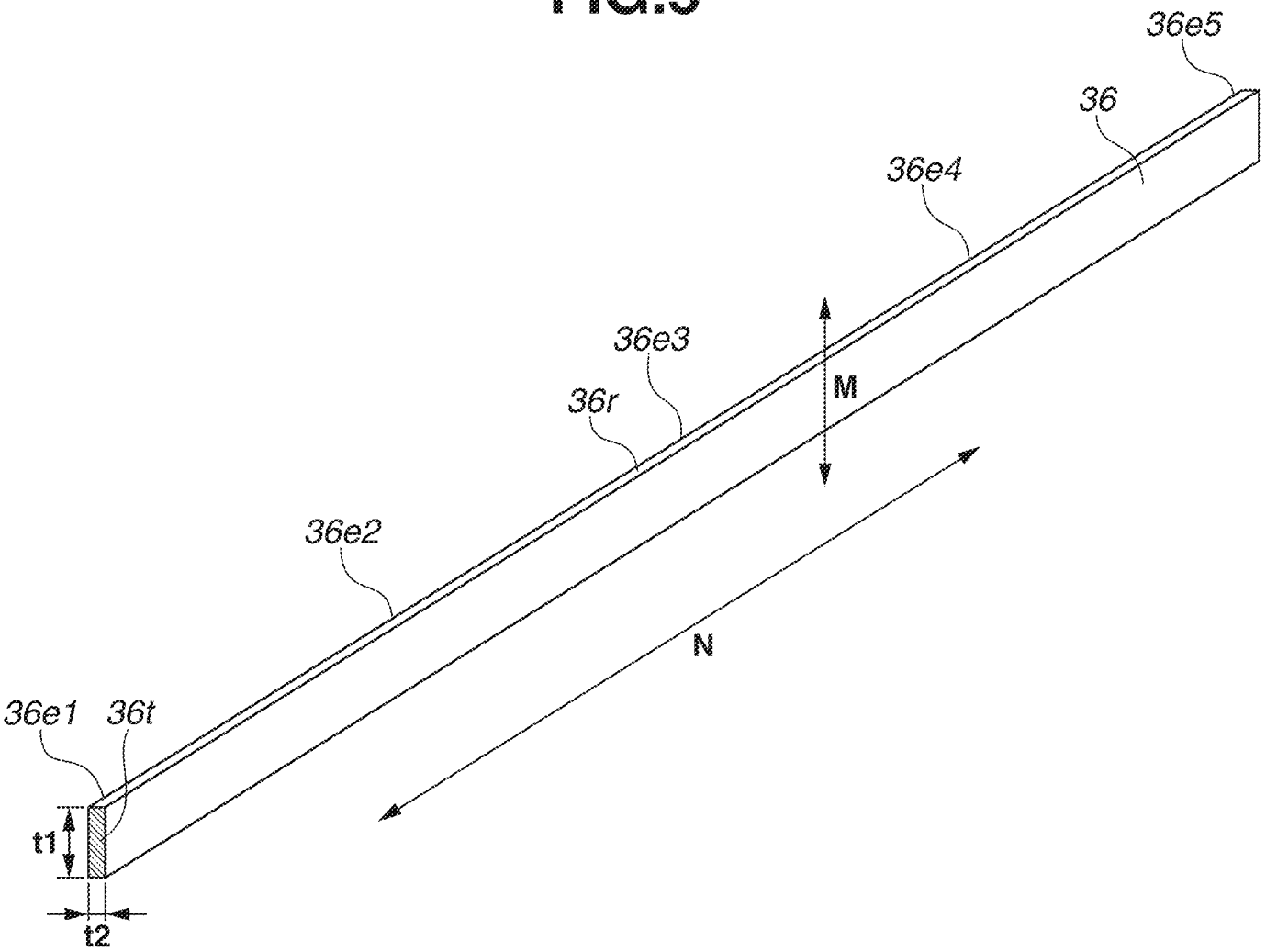
FIG. 5 is a perspective view illustrating a structure of a resin-made doctor blade (alone).

As illustrated in FIG. 5, the doctor blade 36 is formed into a plate shape from the viewpoint of mass production and cost. Further, as illustrated in FIG. 5, a sectional area of a side surface 36*t* of the doctor blade 36 is made small, and a length $t_2$ in a thickness direction of the doctor blade 36 is made smaller than a length $t_1$ in the widthwise direction of the doctor blade 36. In this way, the doctor blade 36 (alone) has a structure in which the doctor blade 36 is more likely to be deformed in the direction (direction indicated by the arrow M in FIG. 5) perpendicular to a longitudinal direction (direction indicated by an arrow N in FIG. 5) of the doctor blade 36. Accordingly, in order to correct the straightness of the coating amount regulating surface 36*r*, the doctor blade 36 is fixed to a blade mounting portion 41 of the developing device frame 30 in a state where at least a part of the doctor blade 36 is flexed in the direction indicated by the arrow M in FIG. 5. The correction of the straightness of the doctor blade 36 will be described in detail below with reference to FIG. 9.

<Structure of Resin-Made Developing Device Frame>

Figure 6:
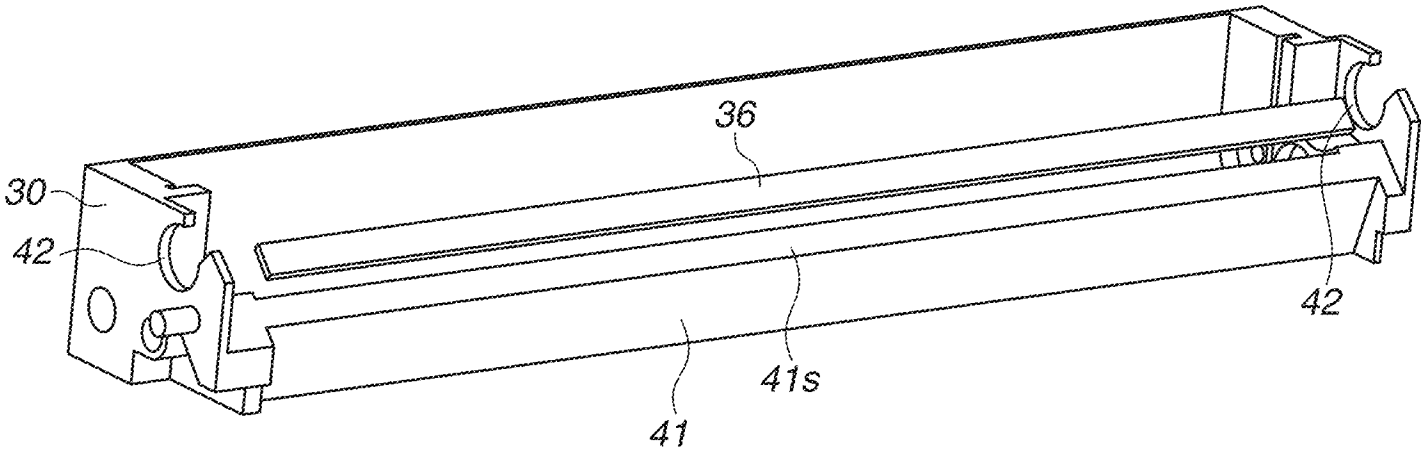
FIG. 6 is a perspective view illustrating a structure of a resin-made developing device frame (alone).

The structure of the developing device frame 30 (alone) will be described with reference to a perspective view illustrated in FIG. 6. FIG. 6 illustrates a state where the cover frame 40 is not mounted on the developing device frame 30.

The developing device frame 30 includes the developing chamber 31 and the stirring chamber 32 that is partitioned from the developing chamber 31 by the partition wall 38. The partition wall 38 is molded from resin. The partition wall 38 may be formed separately from the developing device frame 30, or may be formed integrally with the developing device frame 30.

The developing device frame 30 includes sleeve supporting portions 42 for rotatably supporting the developing sleeve 70 by supporting the bearings 71 provided at both end portions of the developing sleeve 70. The developing device frame 30 also includes the blade mounting portion 41 that is formed integrally with the sleeve supporting portions 42 and is used to mount the doctor blade 36. FIG. 6 illustrates a virtual state where the doctor blade 36 is caused to float from the blade mounting portion 41.

In a state where the doctor blade 36 is mounted on the blade mounting portion 41, an adhesive A coated on a blade mounting surface 41*s* of the blade mounting portion 41 is cured, so that the doctor blade 36 is fixed to the blade mounting portion 41.

<Rigidity of Resin-Made Doctor Blade>

The rigidity of the doctor blade 36 (alone) will be described with reference to a schematic view illustrated in FIG. 7. The rigidity of the doctor blade 36 (alone) is measured in a state where the doctor blade 36 is not fixed to the blade mounting portion 41 of the developing device frame 30.

Figure 7:
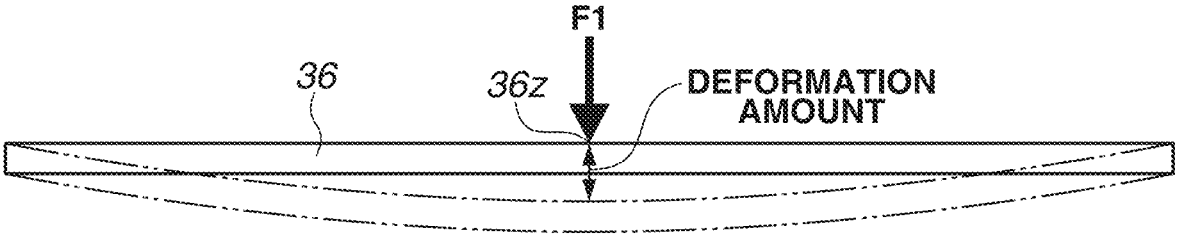
FIG. 7 is a schematic view illustrating rigidity of the resin-made doctor blade (alone).

As illustrated in FIG. 7, a concentrated load F1 is exerted in the widthwise direction of the doctor blade 36 with respect to a central portion 36*z* of the doctor blade 36 in the longitudinal direction of the doctor blade 36. In this case, the rigidity of the doctor blade 36 (alone) is measured based on an amount of flexure of the doctor blade 36 in the widthwise direction at the central portion 36*z* of the doctor blade 36.

For example, assume that the concentrated load F1 of 300 gf is exerted in the widthwise direction of the doctor blade 36 with respect to the central portion 36*z* of the doctor blade 36 in the longitudinal direction of the doctor blade 36. In this case, the amount of flexure of the doctor blade 36 in the widthwise direction at the central portion 36*z* of the doctor blade 36 is 700 μm or more. In this case, the amount of deformation on a section of the central portion 36*z* of the doctor blade 36 is 5 μm or less.

<Example Rigidity of Resin-Made Developing Device Frame>

The rigidity of the developing device frame 30 (alone) will be described with reference to a schematic view illustrated in FIG. 8. The rigidity of the developing device frame 30 (alone) is measured in a state where the doctor blade 36 is not fixed to the blade mounting portion 41 of the developing device frame 30.

Figure 8:
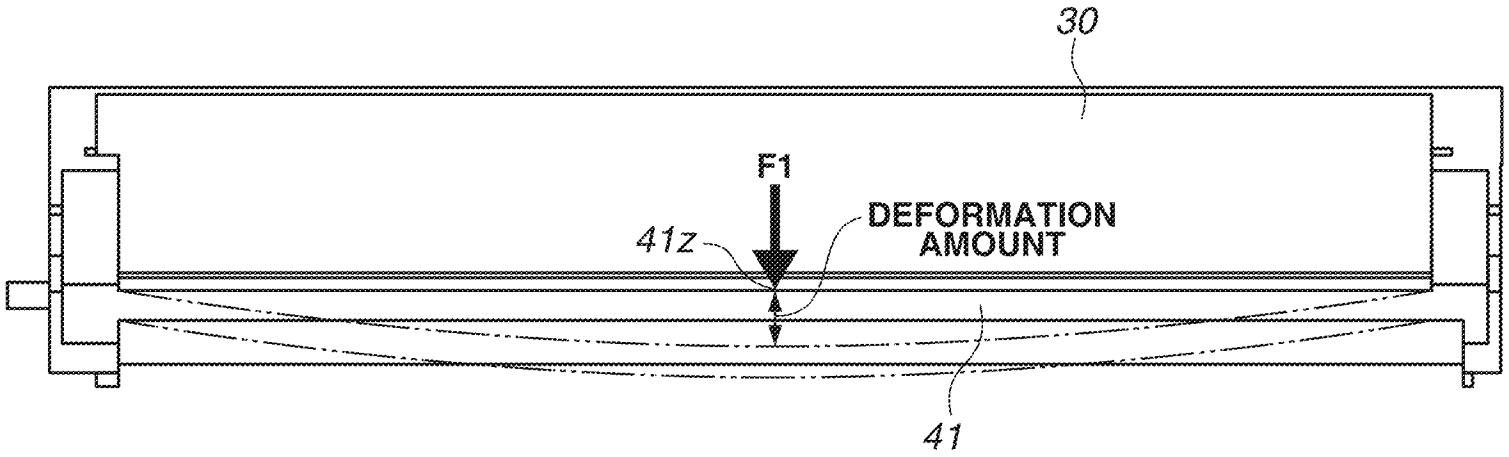
FIG. 8 is a schematic view illustrating the rigidity of the resin-made developing device frame (alone).

As illustrated in FIG. 8, the concentrated load F1 is exerted in the widthwise direction of the blade mounting portion 41 with respect to a central portion 41*z* of the blade mounting portion 41 in the longitudinal direction of the blade mounting portion 41. In this case, the rigidity of the developing device frame 30 (alone) is measured based on the amount of flexure in the widthwise direction of the blade mounting portion 41 at the central portion 41*z* of the blade mounting portion 41.

For example, assume that the concentrated load F1 of 300 gf is exerted in the widthwise direction of the blade mounting portion 41 with respect to the central portion 41*z* of the blade mounting portion 41 in the longitudinal direction of the blade mounting portion 41. In this case, the amount of flexure in the widthwise direction of the blade mounting portion 41 at the central portion 41*z* of the blade mounting portion 41 is 60 μm or less.

Assume that the concentrated load F1 of the same magnitude is exerted on each of the central portion 36*z* of the doctor blade 36 and the central portion 41*z* of the blade mounting portion 41 of the developing device frame 30. In this case, the amount of flexure of the central portion 36*z* of the doctor blade 36 is 10 times or more as high as the amount of flexure of the central portion 41*z* of the blade mounting portion 41. Therefore, the rigidity of the developing device frame 30 (alone) is 10 times or more as high as the rigidity of the doctor blade 36 (alone). For this reason, in a state where the doctor blade 36 is mounted on the blade mounting portion 41 of the developing device frame 30 and the doctor blade 36 is fixed to the blade mounting portion 41 of the developing device frame 30, the rigidity of the developing device frame 30 is dominant over the rigidity of the doctor blade 36. Further, in a case where the doctor blade 36 is fixed to the developing device frame 30 over an entire area of the maximum image region of the doctor blade 36, the rigidity of the doctor blade 36 in a case where the doctor blade 36 is fixed to the developing device frame 30 is higher than that in a case where only the both end portions in the longitudinal direction of the doctor blade 36 are fixed.

The magnitude of the rigidity of the developing device frame 30 (alone) is greater than the magnitude of the rigidity of the cover frame 40 (alone). Accordingly, in a state where the cover frame 40 is mounted on the developing device frame 30 and the cover frame 40 is fixed to the developing device frame 30, the rigidity of the developing device frame 30 is dominant over the rigidity of the cover frame 40.

<Example Correction of Straightness of Resin-Made Doctor Blade>

As the width of the sheet S on which an image is formed increases (e.g., the width of the sheet S is an A3 size), the length of the maximum image region in the image region in which an image can be formed on the surface of the photosensitive drum 1 increases in the rotational axis direction of the developing sleeve 70. Accordingly, the length of the maximum image region of the doctor blade 36 increases as the width of the sheet S on which an image is formed increases. In a case where a doctor blade with a long length in the longitudinal direction is molded from resin, it is difficult to ensure the straightness of the coating amount regulating surface of the resin-made doctor blade molded from resin. This is because, in the case where the doctor blade with a long length in longitudinal direction is molded from resin, when the thermally expanded resin thermally contracts, a portion where the thermal contraction advances and a portion where the thermal contraction is delayed are liable to be generated depending on the position in the longitudinal direction of the doctor blade.

Accordingly, in the resin-made doctor blade, as the length of the doctor blade in the longitudinal direction increases, the SB gap is liable to vary in the longitudinal direction of the developer bearing member due to the straightness of the coating amount regulating surface of the doctor blade. When the SB gap varies in the longitudinal direction of the developer bearing member, there is a possibility that unevenness may occur in the amount of the developer born on the surface of the developer bearing member in the longitudinal direction of the developer bearing member.

For example, in a case where a resin-made doctor blade having a longitudinal length corresponding to an A3 size (this doctor blade is hereinafter referred to as an A3-size compatible resin-made doctor blade) is manufactured with a general resin molded product accuracy, the straightness of the coating amount regulating surface is about 300 μm to 500 μm. Even if the A3-size compatible resin-made doctor blade is manufactured with a high accuracy by using a high-accuracy resin material, the straightness of the coating amount regulating surface is about 100 μm to 200 μm.

In the first example embodiment, the size of the SB gap G is set to about 300 μm, and a tolerance of the SB gap G (i.e., a tolerance with respect to a target value of the SB gap G) is set to ±10% or less. Therefore, in the first example embodiment, this means that an adjustment range of the SB gap G is 300 μm±30 μm and that an allowable tolerance of the SB gap G is 60 μm at maximum. For this reason, even when the A3-size compatible resin-made doctor blade is manufactured with a general resin molded product accuracy, or is manufactured with a high accuracy by using a high-accuracy resin material, a resultant value exceeds an allowable range as the tolerance of the SB gap G only by the accuracy of the straightness of the coating amount regulating surface.

In the developing device including the resin-made doctor blade, the SB gap G desirably falls within a predetermined range in the rotational axis direction of the developer bearing member in a state where the doctor blade is fixed to the mounting portion of the developing device frame, regardless of the straightness of the coating amount regulating surface. Accordingly, in the first example embodiment, even when the resin-made doctor blade in which the straightness of the coating amount regulating surface is low is used, the straightness of the coating amount regulating surface is corrected. With this correction, in a state where the doctor blade is fixed to the mounting portion of the developing device frame, the SB gap G is set to fall within the predetermined range in the rotational axis direction of the developing sleeve 70.

The straightness of the coating amount regulating surface **36*r* of the doctor blade 36 will now be described with reference to a schematic view illustrated in FIG. 9. The straightness of the coating amount regulating surface 36*r* is represented by an absolute value of a difference between a maximum value and a minimum value of the outer shape of the coating amount regulating surface 36*r* based on a predetermined location of the coating amount regulating surface 36*r* in the longitudinal direction of the coating amount regulating surface 36*r*. For example, assume that a central portion of the coating amount regulating surface 36*r* in the longitudinal direction of the coating amount regulating surface 36*r* is defined as an origin of an orthogonal coordinate system, a predetermined straight line passing through the origin is defined as an X-axis, and a straight line vertical to the X-axis from the origin is defined as a Y-axis. In this orthogonal coordinate system, the straightness of the coating amount regulating surface 36*r* is represented by an absolute value of a difference between a maximum value and a minimum value at Y-coordinates of the outer shape of the coating amount regulating surface 36*r***.

Figure 9:
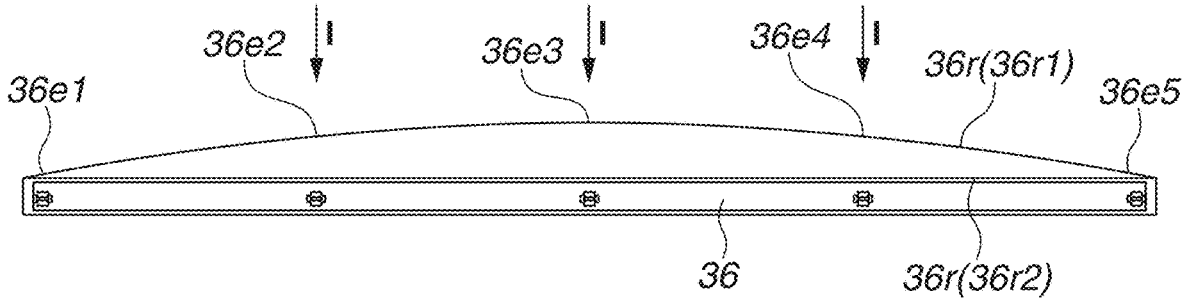
FIG. 9 is a schematic view illustrating straightness of the resin-made doctor blade (alone).

As illustrated in FIG. 9, in the resin-made doctor blade (alone), the shape of the central portion of the coating amount regulating surface **36*r* of the doctor blade 36 in the longitudinal direction of the doctor blade 36 is greatly flexed. Therefore, the straightness of the doctor blade 36 needs to be corrected by reducing a difference between the positions of leading end portions 36*e* (36*e*1 to 36*e*5) of the doctor blade 36 illustrated in FIG. 5. In view of an allowable value of the tolerance of the SB gap G, a mounting accuracy of the doctor blade 36 with respect to the developing device frame 30, and the like, the straightness of the coating amount regulating surface 36*r* of the doctor blade 36 needs to be corrected to 50 μm or less. Considering that the accuracy of the straightness of a doctor blade made of metal by a secondary cutting process is 20 μm or less, it is more preferable to correct the straightness of the coating amount regulating surface 36*r* of the resin-made doctor blade 36 to 20 μm or less. In view of the actual mass-production process, a setting value for correcting the straightness of the coating amount regulating surface 36*r* of the doctor blade 36** is set to about 20 μm to 50 μm.

Accordingly, a force (also referred to as a straightness correction force) for flexing at least a part of the maximum image region of the doctor blade 36 is applied to the doctor blade 36, to thereby flex at least a part of the maximum image region of the doctor blade 36. Thus, the straightness of the coating amount regulating surface **36*r* of the doctor blade 36** is corrected to 50 μm or less.

In an example illustrated in FIG. 9, the straightness correction force is applied to each of the leading end portions **36*e*2, 36*e*3, and 36*e*4 in a direction indicated by an arrow I in FIG. 9 so that the outer shapes of the leading end portions 36*e*2, 36*e*3, and 36*e*4 are adjusted based on the outer shapes of the leading end portions 36*e*1 and 36*e*5 of the doctor blade 36. As a result, the shape of the coating amount regulating surface 36***r* of the doctor blade 36 is corrected from a coating amount regulating surface 36*r*1 to a coating amount regulating surface 36*r*2, so that the straightness of the coating amount regulating surface 36*r* of the doctor blade 36 can be corrected to 50 μm or less. In the example illustrated in FIG. 9, the outer shape of each leading end portion 36*e* of the doctor blade 36 is adjusted based on the outer shapes of the leading end portions 36*e*1 and 36*e*5 (both end portions in the longitudinal direction of the coating amount regulating surface 36*r*), but instead may be adjusted based on the outer shape of the leading end portion 36*e*3 (the central portion in the longitudinal direction of the coating amount regulating surface 36*r*). In this case, the straightness correction force is applied to the doctor blade 36 so that the outer shapes of the leading end portions 36*e*1, 36*e*2, 36*e*4, and 36*e*5 are adjusted based on the outer shape of the leading end portion 36*e*3 of the doctor blade 36.

In this manner, in order to correct the straightness of the doctor blade 36, the rigidity of the doctor blade (alone) needs to be reduced so that at least a part of the maximum image region of the coating amount regulating surface 36*r* is flexed when the straightness correction force is applied to the doctor blade 36.

<Example Method for Adjusting SB Gap>

The SB gap G is adjusted by moving the position of the doctor blade 36 with respect to the developing device frame 30 so as to adjust the position of the doctor blade 36, which is mounted on the blade mounting portion 41, relative to the developing sleeve 70 supported by the sleeve supporting portions 42. At a predetermined position of the blade mounting portion 41 that is determined by adjusting the SB gap G, the flexed doctor blade 36 obtained by flexing at least a part of the maximum image region of the flexed doctor blade 36 is fixed with the adhesive A coated in advance over an entire maximum image region of the blade mounting surface 41*s*. The maximum image region of the blade mounting surface 41*s* refers to a region of the blade mounting surface 41*s* corresponding to the maximum image region in the image region in which an image can be formed on the surface of the photosensitive drum 1 in the rotational axis direction of the developing sleeve 70. In this case, in the maximum image region of the doctor blade 36, the region flexed to correct the coating amount regulating surface 36*r* is fixed to the blade mounting portion 41. The adhesive A need not necessarily be coated on a part of the blade mounting surface 41*s*, as long as a region that receives a force for flexing at least a part of the maximum image region of the doctor blade 36 is fixed to the blade mounting portion 41 with the adhesive A. In this regard, if the adhesive A is coated over the entirety of the maximum image region of the blade mounting surface 41*s*, the following condition is satisfied. The condition is such that the adhesive A is coated on a region of 95% or more of the maximum image region of the blade mounting surface 41*s*, including the region flexed to correct the straightness of the coating amount regulating surface 36*r* in the region corresponding to the maximum image region of the doctor blade 36.

Thus, it is possible to prevent the region flexed to correct the straightness of the coating amount regulating surface 36*r* in the maximum image region of the doctor blade 36 from being recovered from the flexed state to the non-flexed original state. With this structure, the doctor blade 36 is fixed to the blade mounting portion 41 in a state where the straightness of the coating amount regulating surface 36*r* is corrected to 50 μm or less.

The size of the SB gap G is measured (calculated) by the following method. The size of the SB gap G is measured in a state where the developing sleeve 70 is supported by the sleeve supporting portions 42 of the developing device frame 30, the doctor blade 36 is mounted on the blade mounting portion 41 of the developing device frame 30, and the cover frame 40 is fixed to the developing device frame 30.

To measure the size of the SB gap G, a light source (e.g., a light-emitting diode (LED) array or a light guide) is inserted into the developing chamber 31 along the longitudinal direction of the developing chamber 31. The light source inserted into the developing chamber 31 emits light from the inside of the developing chamber 31 to the SB gap G. In addition, cameras for capturing light beams emitted from the SB gap G to the outside of the developing device frame 30 are disposed at five locations respectively corresponding to the leading end portions 36*e* (i.e., 36*e*1 to 36*e*5) of the doctor blade 36.

To measure the positions of the leading end portions 36*e* (36*e*1 to 36*e*5) of the doctor blade 36, the cameras provided at the five locations, respectively, capture light beams emitted from the SB gap G to the outside of the developing device frame 30. In this case, each camera detects the position where the developing sleeve 70 comes closest to the doctor blade 36 on the surface of the developing sleeve 70 and the leading end portions 36*e* (36*e*1 to 36*e*5) of the doctor blade 36. Next, the size of the SB gap G is calculated by converting each pixel value from image data read and generated by the camera into a distance. If the calculated size of the SB gap G does not fall within a predetermined range, the SB gap G is adjusted. Then, when the size of the calculated SB gap G falls within the predetermined range, the obtained position is determined to be a position where the doctor blade 36 obtained by flexing at least a part of the maximum image region of the doctor blade 36 is fixed to the blade mounting portion 41 of the developing device frame 30.

Whether the SB gap G falls within the predetermined range in the rotational axis direction of the developing sleeve 70 is determined by the following method. First, the maximum image region of the doctor blade 36 is divided into four or more segments at equal intervals, and the SB gap G is measured at five or more locations in each segment of the doctor blade 36 (including both end portions and the center portion of the maximum image region of the doctor blade 36). Then, a maximum value of the SB gap G, a minimum value of the SB gap G, and a median value of the SB gap G are extracted from samples of the measurement value of the SB gap G measured at five or more locations.

In this case, an absolute value of a difference between the maximum value of the SB gap G and the median value of the SB gap G may have to be 10% or less of the median value of the SB gap G, and an absolute value of a difference between the minimum value of the SB gap G and the median value of the SB gap G may have to be 10% or less of the median value of the SB gap G. In this case, assume that the tolerance of the SB gap G is ±10% or less, and the SB gap G falls within a predetermined range in the rotational axis direction of the developing sleeve 70. For example, if the median value of the SB gap G is 300 μm based on the samples of the measurement value of the SB gap G measured at five or more locations, the maximum value of the SB gap G may have to be set to 330 μm or less and the minimum value of the SB gap G may be set to 270 μm or more. In other words, in this case, the adjustment range of the SB gap G is 300 μm±30 μm and an allowable tolerance of the SB gap G (i.e., a tolerance with respect to the target value of the SB gap G) is 60 μm at maximum.

<Linear Expansion Coefficients>

Next, deformation of each of the doctor blade 36 and the developing device frame 30 caused by a temperature change due to heat generated during the image forming operation will be described with reference to a perspective view illustrated FIG. 10. Examples of the heat generated during the development operation include heat generated when the rotational shaft of the developing sleeve 70 and the bearings 71 are rotated, heat generated when the rotational shaft 33*a* of the first conveyance screw 33 and the bearing member thereof are rotated, and heat generated when the developer passes through the SB gap G. A temperature in the vicinity of the developing device 3 changes due to such heat generated during the image forming operation, so that the temperature of each of the doctor blade 36, the developing device frame 30, and the cover frame 40 also changes.

Figure 10:
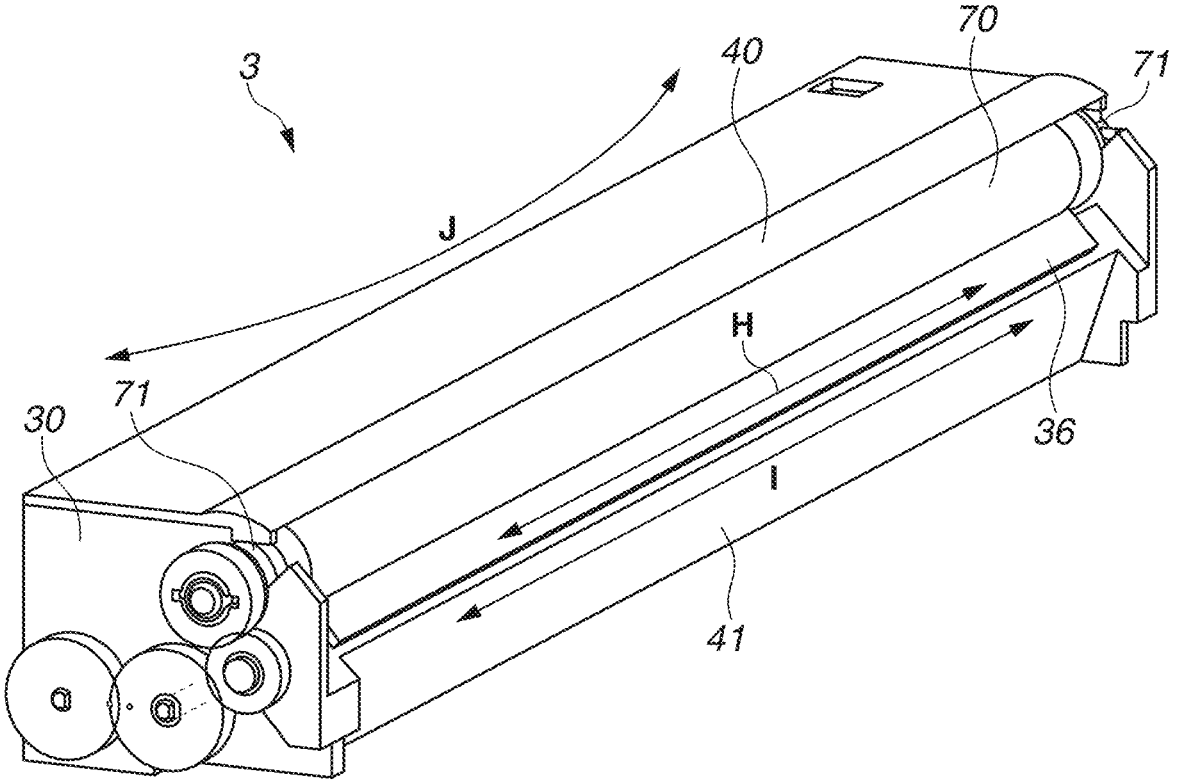
FIG. 10 is a perspective view illustrating deformation of the resin-made doctor blade due to a temperature change.

As illustrated in FIG. 10, an elongation amount of the doctor blade 36 caused by a temperature change is set as H [μm], and an elongation amount of the blade mounting surface 41*s* of the blade mounting portion 41 of the developing device frame 30 caused by a temperature change is set as I [μm]. Also, assume that a linear expansion coefficient α1 of the resin forming the doctor blade 36 is different from a linear expansion coefficient α2 of the resin forming the developing device frame 30. In this case, the amount of deformation caused by a temperature change is different between the developing device frame 30 and the doctor blade 36 due to the difference between the linear expansion coefficients α1 and α2. To compensate for the difference between H [μm] and I [μm], the doctor blade 36 is deformed in a direction indicated by an arrow J in FIG. 10. The deformation of the doctor blade 36 in the direction indicated by the arrow J in FIG. 10 is hereinafter referred to as deformation in a warp direction of the doctor blade 36. The deformation in the warp direction of the doctor blade 36 causes a variation in the size of the SB gap G. In order to prevent a variation in the size of the SB gap G due to heat, the linear expansion coefficient α2 of the resin forming the blade mounting portion 41 and the sleeve supporting portions 42 of the developing device frame 30 (alone) and the linear expansion coefficient α1 of the resin forming the doctor blade 36 (alone) are related. More specifically, when the linear expansion coefficient α1 of the resin forming the doctor blade 36 is different from the linear expansion coefficient α2 of the resin forming the developing device frame 30, the amount of deformation caused by a temperature change varies due to the difference between the linear expansion coefficients α1 and α2.

In general, a resin material has a linear expansion coefficient larger than that of a metal material. When the doctor blade 36 is made of a resin material, warping deformation occurs in the doctor blade 36 due to a temperature change caused by heat generated during the image forming operation, and the longitudinal central portion of the doctor blade 36 is easily flexed. As a result, in the developing device in which the resin-made doctor blade 36 is fixed to a resin-made development frame, the size of the SB gap G is liable to vary as the temperature changes during the image forming operation.

At least a part of the maximum image region of the doctor blade 36 is flexed to correct the straightness of the coating amount regulating surface 36*r* within 50 μm or less. In addition, a method for fixing the doctor blade 36, which is obtained by flexing at least a part of the maximum image region of the doctor blade 36, to the blade mounting portion 41 of the developing device frame 30 with the adhesive A over the entire maximum image region of the doctor blade 36, is employed.

In this case, if there is a large difference between the linear expansion coefficient α2 of the resin forming the developing device frame 30 and the linear expansion coefficient α1 of the resin forming the doctor blade 36, the difference causes the following issue when a temperature change occurs. That is, when a temperature change occurs, the amount of deformation (amount of expansion/contraction) of the doctor blade 36 caused by the temperature change is different from the amount of deformation (amount of expansion/contraction) of the developing device frame 30 caused by the temperature change. As a result, even if the SB gap G is adjusted with a high accuracy to determine the position where the doctor blade 36 is mounted on the blade mounting surface 41*s* of the developing device frame 30, the size of the SB gap G varies due to a temperature change during the image forming operation.

Since the doctor blade 36 is fixed to the blade mounting surface 41*s* over the entire maximum image region, a variation in the size of the SB gap G due to a temperature change during the image formation operation may be desirably prevented. In general, in order to prevent unevenness in the amount of the developer born on the surface of the developing sleeve 70 in the longitudinal direction of the developing sleeve 70, a variation amount of the SB gap G due to heat needs to be reduced to ±20 μm or less.

A difference between the linear expansion coefficient α2 of the resin forming the developing device frame 30 including the sleeve supporting portions 42 and the blade mounting portion 41 and the linear expansion coefficient α1 of the resin forming the doctor blade 36 is hereinafter referred to as a linear expansion coefficient difference α2−α1. A change in the maximum flexure amount of the doctor blade 36 caused by the linear expansion coefficient α2−α1 is described with reference to Table 1. The maximum flexure amount of the doctor blade 36 was measured when a temperature change from a room temperature (23° C.) to a high temperature (40° C.) is applied in a state where the doctor blade 36 is fixed to the blade mounting portion 41 of the developing device frame 30 over the entire maximum image region of the doctor blade 36.

Assume that the linear expansion coefficient of the resin forming the developing device frame 30 including the sleeve supporting portions 42 and the blade mounting portion 41 is represented by α2 [m/° C.] and the linear expansion coefficient of the resin forming the doctor blade 36 is represented by α1 [m/° C.]. In addition, the maximum flexure amount of the doctor blade 36 was measured by changing a parameter of the linear expansion coefficient difference α2−α1. Table 1 illustrates the result of the measurement. In Table 1, when the absolute value of the maximum flexure amount of the doctor blade 36 is 20 μm or less, the maximum flexure amount is denoted by "○", and when the absolute value of the maximum flexure amount of the doctor blade 36 is more than 20 μm, the maximum flexure amount is denoted by "x".

TABLE 1

| | Linear Expansion Coefficient Difference $\alpha 2 - \alpha 1$ [$\times 10^{-5}$ m/° C.] | | | | | | | | |
|---|---|---|---|---|---|---|---|---|---|
| | 0 | +0.20 | +0.40 | +0.50 | +0.54 | +0.55 | +0.56 | +0.57 | +0.60 |
| Maximum Flexure Amount of Doctor Blade | ○ | ○ | ○ | ○ | ○ | ○ | x | x | x |
| | Linear Expansion Coefficient Difference $\alpha 2 - \alpha 1$ [$\times 10^{-5}$ m/° C.] | | | | | | | | |
| | 0 | −0.20 | −0.40 | −0.44 | −0.45 | −0.46 | −0.47 | −0.50 | |
| Maximum Flexure Amount of Doctor Blade | ○ | ○ | ○ | ○ | ○ | x | x | x | |

As seen from Table 1, in order to reduce the amount of variation of the SB gap G due to heat to ±20 m or less, the linear expansion coefficient difference $\alpha 2-\alpha 1$ needs to satisfy the following relational expression (1).

$$-0.45\times10^{-5}\ [\text{m/° C.}] \leq \alpha 2-\alpha 1 \leq 0.55\times10^{-5}\ [\text{m/° C.}] \quad (1)$$

In this regard, the resin forming the developing device frame 30 and the resin forming the doctor blade 36 may need to be selected so that the linear expansion coefficient difference $\alpha 2-\alpha 1$ is in a range from $-0.45\times10^{-5}$ [m/° C.] to $0.55\times10^{-5}$ [m/° C.]. If the same resin is selected as the resin forming the developing device frame 30 and the resin forming the doctor blade 36, the linear expansion coefficient difference $\alpha 2-\alpha 1$ becomes zero.

When the adhesive A is coated on the doctor blade 36 or the developing device frame 30, the linear expansion coefficient of the doctor blade 36 or the developing device frame 30 coated with the adhesive A varies. However, the volume of the adhesive A coated on the doctor blade 36 or the developing device frame 30 is extremely small, and thus the influence on a dimensional variation in the thickness direction of the adhesive A caused by a temperature change is negligible. Accordingly, when the adhesive A is coated on the doctor blade 36 or the developing device frame 30, deformation in the warp direction of the doctor blade 36 caused by a variation of the linear expansion coefficient difference $\alpha 2-\alpha 1$ is negligible.

Similarly, since the cover frame 40 is fixed to the developing device frame 30, if the deformation amount of the developing device frame 30 is different from the deformation amount of the cover frame 40 due to a temperature change, deformation of the cover frame 40 in the warp direction causes a variation in the size of the SB gap G. Assume that the linear expansion coefficient of the resin forming the developing device frame 30 including the sleeve supporting portions 42 and the blade mounting portion 41 is represented by $\alpha 2$ [m/° C.], and the linear expansion coefficient of the resin forming the cover frame 40 is represented by $\alpha 3$ [m/° C.]. In addition, a difference between the linear expansion coefficient $\alpha 3$ of the resin forming the cover frame 40 and the linear expansion coefficient $\alpha 2$ of the resin forming the developing device frame 30 including the sleeve supporting portions 42 and the blade mounting portion 41 is hereinafter referred to as a linear expansion coefficient difference $\alpha 3-\alpha 2$. In this case, the linear expansion coefficient difference $\alpha 3-\alpha 2$ needs to satisfy the following relational expression (2) as in Table 1.

$$-0.45\times10^{-5}\ [\text{m/° C.}] \leq \alpha 3-\alpha 2 \leq 0.55\times10^{-5}\ [\text{m/° C.}] \quad (2)$$

In this regard, the resin forming the developing device frame 30 and the resin forming the cover frame 40 may only need to be selected so that the linear expansion coefficient difference $\alpha 3-\alpha 2$ is in a range from $-0.45\times10^{-5}$ [m/° C.] to $0.55\times10^{-5}$ [m/° C.]. If the same resin is selected as the resin forming the developing device frame 30 and the resin forming the cover frame 40, the linear expansion coefficient difference $\alpha 3-\alpha 2$ becomes zero.

<Example Developer Pressure>

Figure 11:
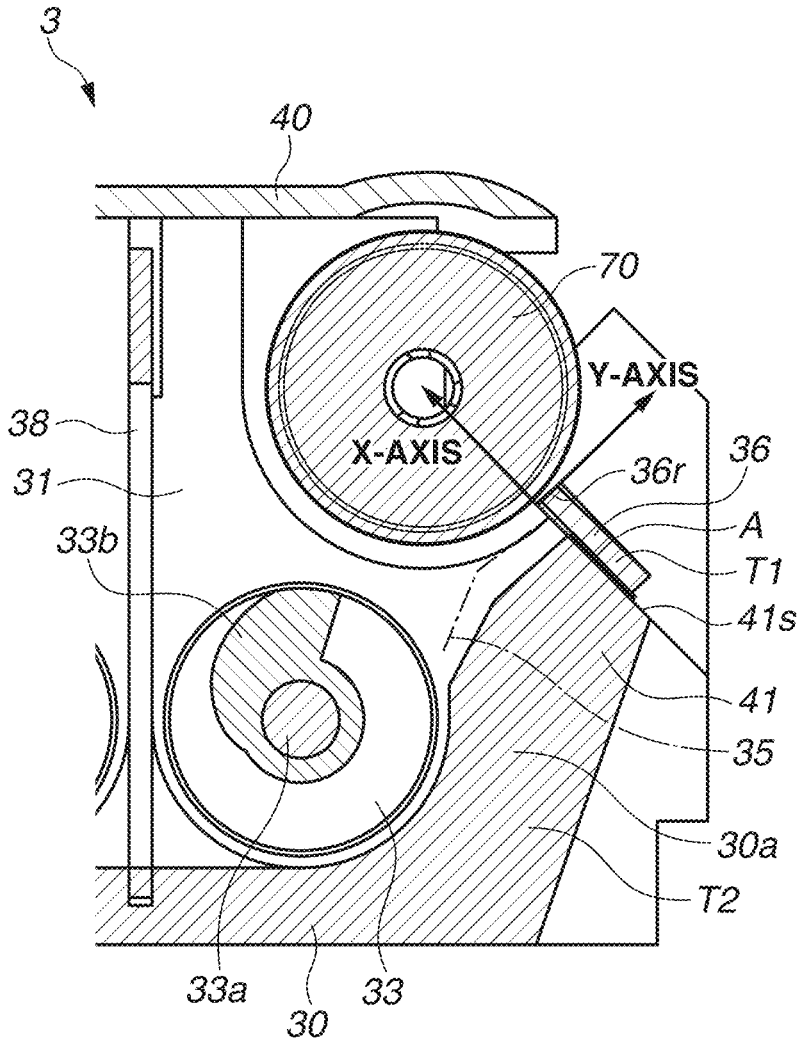
FIG. 11 is a sectional view illustrating deformation of the resin-made doctor blade due to a developer pressure.

Next, deformation of the doctor blade 36 caused by the developer pressure that is generated from a developer flow during the image forming operation and is applied to the doctor blade 36 will be described with reference to a sectional view illustrated in FIG. 11. FIG. 11 is a sectional view illustrating the developing device 3 in a section (section H illustrated in FIG. 2) perpendicular to the rotational axis of the developing sleeve 70. FIG. 11 also illustrates a structure in the vicinity of the doctor blade 36 fixed to the blade mounting portion 41 of the developing device frame 30 with the adhesive A.

As illustrated in FIG. 11, a line connecting a closest position of the doctor blade 36 and the developing sleeve 70 in the coating amount regulating surface **36*r* and a rotation center of the developing sleeve 70 is defined as the X-axis. In this case, the doctor blade 36 has a long length in the X-axis direction and a high rigidity at a section in the X-axis direction. Further, as illustrated in FIG. 11, a proportion of a sectional area T1 of the doctor blade 36 to a sectional area T2 of a wall portion 30*a* of the developing device frame 30 located in the vicinity of the developer guide portion 35** is small.

As described above, the rigidity of the developing device frame 30 (alone) is 10 times or more as high as the rigidity of the doctor blade 36 (alone). Accordingly, the rigidity of the developing device frame 30 with respect to the doctor blade 36 is dominant over the rigidity of the doctor blade 36 in a state where the doctor blade 36 is fixed to the blade mounting portion 41 of the developing device frame 30. As a result, during the image forming operation, a displacement (maximum flexure amount) of the coating amount regulating surface **36*r* of the doctor blade 36 when the doctor blade 36 receives the developer pressure is substantially equivalent to a displacement (maximum flexure amount) of the developing device frame 30**.

During the image forming operation, the developer scooped up from the first conveyance screw 33 is conveyed to the surface of the developing sleeve 70 through the developer guide portion 35. After that, the doctor blade 36 receives the developer pressure from various directions also when the layer thickness of the developer is defined to match the size of the SB gap G by the doctor blade 36. As illustrated in FIG. 11, assuming that a direction perpendicular to the X-axis direction (a direction in which the SB gap G is defined) is a Y-axis direction, the development pressure in the Y-axis direction is applied in the direction perpendicular to the blade mounting surface 41*s* of the developing device frame 30. In other words, the developer pressure in the Y-axis direction becomes a force in a direction in which the doctor blade 36 is detached from the blade mounting surface 41*s*. Therefore, a bonding force of the adhesive A may need to be sufficiently larger than the developer pressure in the Y-axis direction. In this regard, an adhering area or a coat thickness of the adhesive A on the blade mounting surface 41*s* is optimized in consideration of the force of detaching the doctor blade 36 from the blade mounting surface 41*s* by the developer pressure, and the adhesive force of the adhesive A.

<Example Structure of Developing Device According to First Example Embodiment>

As described above, the developing device including the resin-made doctor blade 36 and the resin-made developing device frame 30 may have a structure in which the resin-made doctor blade 36 is mounted in a fixed manner on the blade mounting portion 41 of the resin-made developing device frame 30.

Further, as described above, the length in the longitudinal direction of the maximum image region of the doctor blade 36 increases as the width of the sheet S on which an image is formed increases. The length in the longitudinal direction of the blade mounting surface 41*s* increases as the length in the longitudinal direction of the maximum image region of the doctor blade 36 increases.

In a case where the developing device frame 30 having a longer length in the longitudinal direction of the blade mounting surface 41*s* is molded from resin, unevenness of the blade mounting surface 41*s* is more likely to increase, so that the flatness (Japanese Industrial Standards (JIS) B0021) of the blade mounting surface 41*s* is liable to increase. This is because, in general, a variation in flatness in the longitudinal direction of a resin molded product is liable to occur as the length in the longitudinal direction of the resin molded product increases.

In the first example embodiment, when the doctor blade 36 is mounted and fixed (bonded) onto the blade mounting surface 41*s* with the adhesive A, the mounting device for the doctor blade 36 (hereinafter referred to as a blade mounting device) is used. Further, in the first example embodiment, an orientation of the developing device frame 30 is converted so as to make the blade mounting surface 41*s* be substantially parallel to an installation surface (horizontal surface) of the blade mounting device, and the developing device frame 30 is installed in the blade mounting device. In this case, the inclination of the blade mounting surface 41*s* with respect to the installation surface (horizontal surface) of the blade mounting device tends to be greater when the flatness of the blade mounting surface 41*s* is large than when the flatness of the blade mounting surface 41*s* is small. In addition, there is a possibility that the position of the doctor blade 36 relative to the developing sleeve 70 when the doctor blade 36 is mounted on the blade mounting surface 41*s* may vary as the inclination of the blade mounting surface 41*s* with respect to the installation surface (horizontal surface) of the blade mounting device increases. The position of the doctor blade 36 relative to the developing sleeve 70 includes a position where the doctor blade 36 comes closest to the developing sleeve 70.

On the other hand, the size of the SB gap G in a state where the doctor blade 36 is fixed (bonded) to the blade mounting surface 41*s* is liable to vary in the longitudinal direction of the developing sleeve 70 as a variation amount of the position of the doctor blade 36 relative to the developing sleeve 70 increases. Further, when the size of the SB gap G varies in the longitudinal direction of the developing sleeve 70, there is a possibility that unevenness may occur in the amount of the developer born on the surface of the developing sleeve 70 in the longitudinal direction of the developing sleeve 70.

Accordingly, a variation in the position of the doctor blade 36 relative to the developing sleeve 70 may be desirably prevented when the doctor blade 36 is mounted on the blade mounting surface 41*s*, regardless of the flatness of the blade mounting surface 41*s* of the developing device frame 30.

According to the first example embodiment, it is possible to provide a developing device having a structure in which a variation in a position where a resin-made regulating blade comes closest to a developer bearing member when the regulating blade is mounted on a resin-made developing device frame is prevented and the SB gap G is set to fall within a predetermined range in the longitudinal direction of the developer bearing member. The developing device will be described in detail below.

Figure 12:
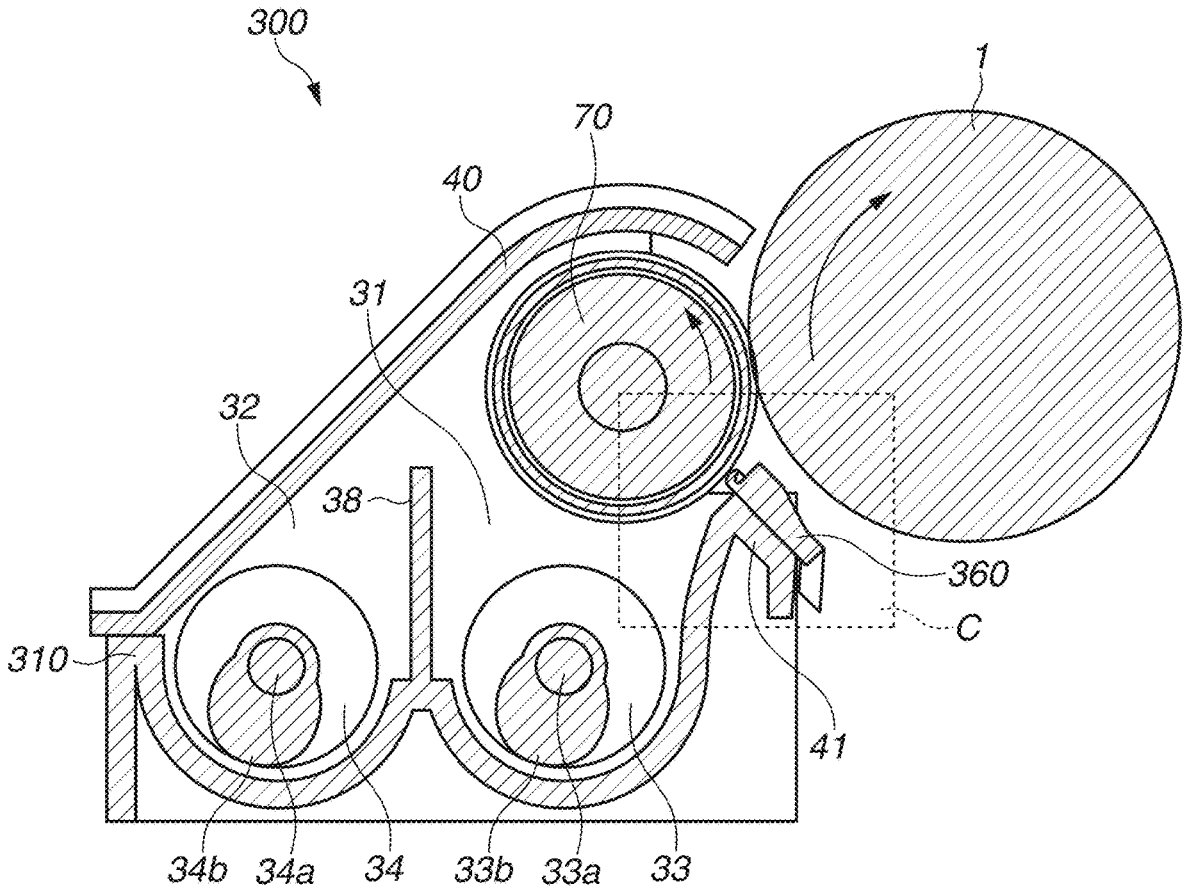
FIG. 12 is a sectional view illustrating a structure of a developing device according to the first example embodiment.
Figure 13:
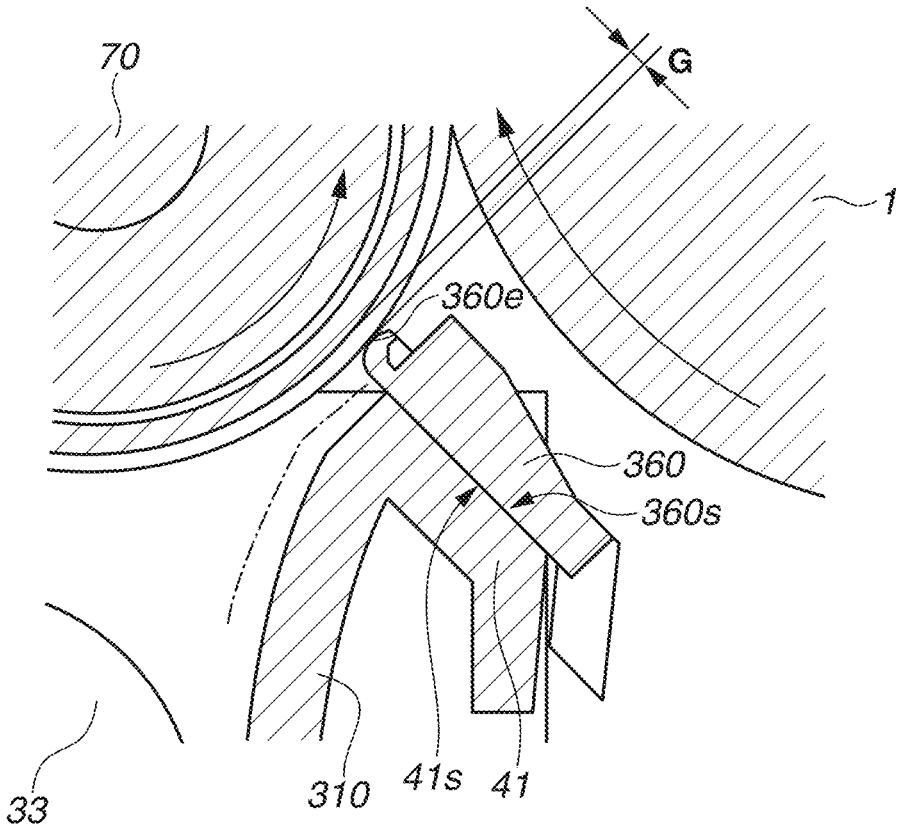
FIG. 13 is an enlarged view illustrating the structure of the developing device according to the first example embodiment.

The structure of the developing device according to the first example embodiment will be described with reference to a sectional view illustrated in FIG. 12 and an enlarged view illustrated in FIG. 13. FIG. 12 is a sectional view of a developing device 300 taken along a section perpendicular to the rotational axis of the developing sleeve 70. FIG. 13 is an enlarged view of the developing device 300 in a sectional region C (in the vicinity of a doctor blade 360) illustrated in FIG. 12. Components in FIGS. 12 and 13 that are identical to those in FIGS. 2, 3, and 4 are denoted by the same reference symbols. Differences between the structure of the developing device 300 according to the first example embodiment and the structure of the developing device 3 described above with reference to FIGS. 2, 3, and 4 will be mainly described below.

In the first example embodiment, in the case of mounting and fixing the doctor blade 360 onto the blade mounting surface 41*s*, a developing device frame 310 is installed in the device with such an orientation that the blade mounting surface 41*s* is substantially parallel to the installation surface (horizontal surface) of the blade mounting device.

The structure of the blade mounting device will now be described with reference to a schematic view illustrated in FIG. 14. The orientation of the doctor blade 360 (i.e., the position of the doctor blade 360 relative to the developing sleeve 70 when the doctor blade 360 is mounted on the blade mounting surface 41*s*) at the time of mounting the doctor blade 360 will be described with reference to enlarged views illustrated in FIGS. 15, 16, 17A, and 17B. FIGS. 15, 16, 17A, and 17B each illustrate a sectional view of the developing device 300 along a section perpendicular to the rotational axis of the developing sleeve 70. FIGS. 15, 16, 17A, and 17B each illustrate a state where the orientation of the developing device frame 310 is converted so that the blade mounting surface 41*s* illustrated in the sectional view of FIG. 12 is substantially parallel to the installation surface (horizontal surface) of the blade mounting device.

Figure 14:
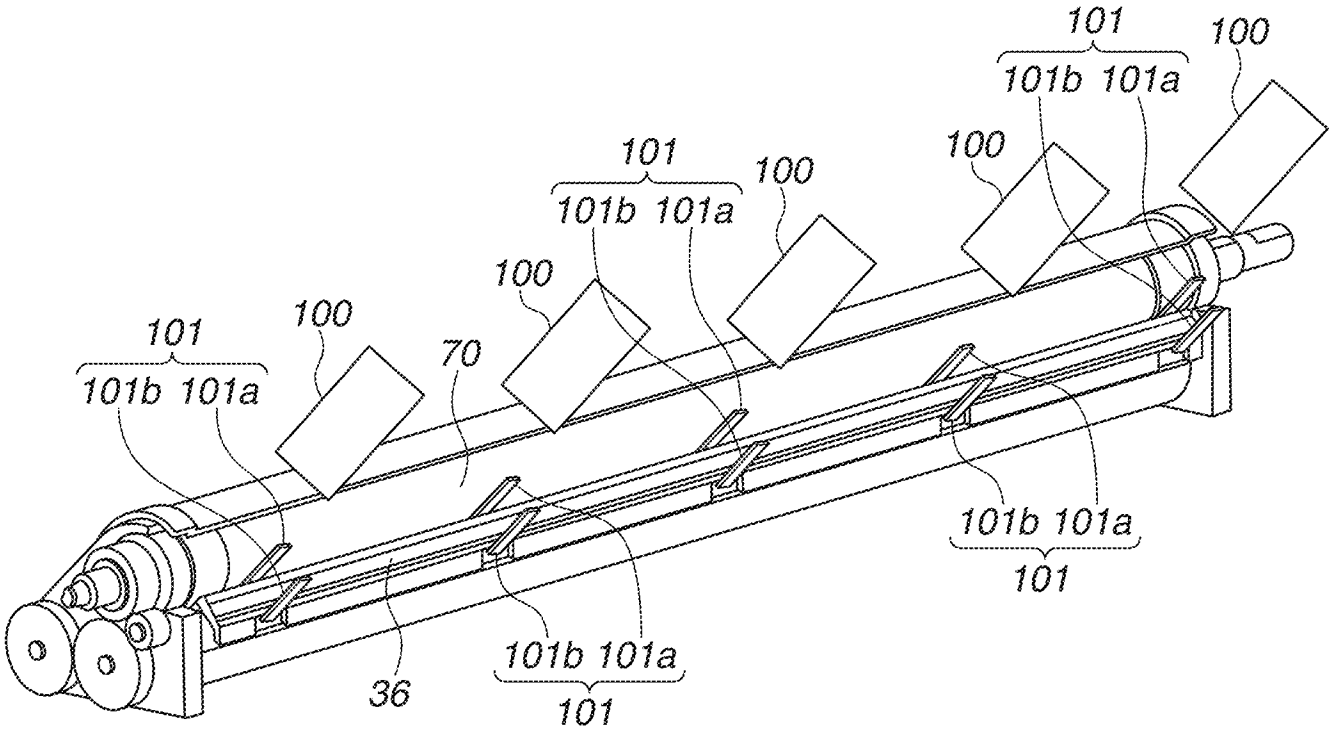
FIG. 14 is a schematic view illustrating a structure of a mounting device of the resin-made doctor blade.

As illustrated in FIG. 14, the blade mounting device includes cameras 100 provided at five locations, respectively, in the rotational axis direction of the developing sleeve 70. The cameras 100 provided at five locations, respectively, can measure the size of the SB gap G at leading end portions 360*e* (360*e*1 to 360*e*5) of the doctor blade 360 at the respective positions of the cameras 100. The leading end portions 360*e* (360*e*1 to 360*e*5) of the doctor blade 360 are disposed at a closest position where the doctor blade 360 comes closest to the developing sleeve 70 when the doctor blade 360 is mounted on the blade mounting surface 41*s*.

An installation axis of each camera 100 is placed substantially perpendicular to a straight line M connecting a rotation center 70*a* of the developing sleeve 70 and the leading end portion 360*e* (closest position where the doctor blade 360 comes closest to the developing sleeve 70) of the doctor blade 360. Thus, each camera 100 measures the size of the SB gap G. A straight line M is substantially parallel to the installation surface (horizontal surface) of the blade mounting device.

Figure 15:
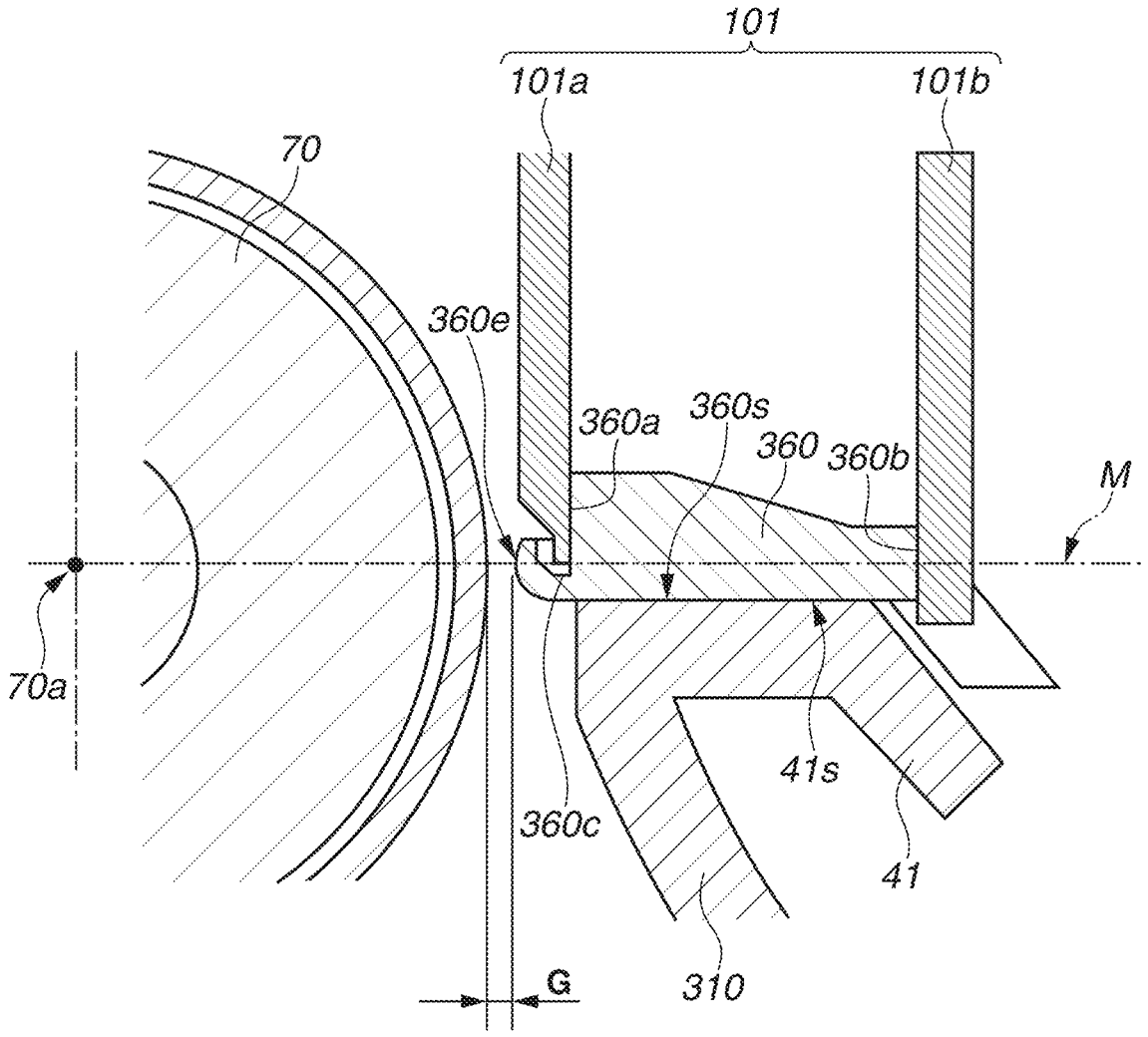
FIG. 15 is an enlarged view illustrating an orientation of the resin-made doctor blade when the doctor blade is mounted.

As illustrated in FIG. 14, the blade mounting device includes grip units 101, each of which is composed of a first grip member 101*a* and a second grip member 101*b* and used to grip the doctor blade 360, at positions respectively corresponding to the five cameras 100. As illustrated in FIG. 15, the first grip member 101*a* grips a first vertical surface 360*a* of the doctor blade 360 that is perpendicular to the straight line M. The second grip member 101*b* grips a second vertical surface 360*b* of the doctor blade 360 that is perpendicular to the straight line M. The first vertical surface 360*a* is provided substantially parallel to the second vertical surface 360*b*. Further, the first vertical surface 360*a* is provided at a location closer to the developing sleeve 70 than the second vertical surface 360*b*. The first vertical surface 360*a* and the second vertical surface 360*b* of the doctor blade 360 are respectively nipped by the grip member 101*a* and the grip member 101*b* of the grip unit 101, thereby gripping the doctor blade 360.

FIG. 14 illustrates an example in which five cameras 100 and five grip units 101 are installed at certain intervals in the rotational axis direction of the developing sleeve 70 in the blade mounting device. The number of cameras 100 and the number of grip units 101 are not particularly limited thereto and may be appropriately set depending on the required accuracy of the SB gap G.

As for the doctor blade 360 gripped by each grip unit 101, the surface of the developing sleeve 70 and the leading end portion 360*e* of the doctor blade 360 are detected by each of the five cameras 100 and the size of the SB gap G at each of the five locations is calculated based on the position measurement. Further, based on the result of calculating the size of the SB gap G, each of the five grip units 101 moves in the direction of the straight line M and is adjusted to a desired size (300 μm in the first example embodiment) of the SB gap G. The process of adjusting the size of the SB gap G is desirably performed immediately before a mounted surface (attached surface) 360*s* of the doctor blade 360 is mounted on (contacts) the blade mounting surface 41*s*, in terms of the accuracy of adjusting the size of the SB gap G. This is because, if the cameras 100 have different focal lengths between the surface of the developing sleeve 70 and the leading end portion 360*e* of the doctor blade 360, a position measurement error occurs. This results in deterioration of the accuracy of adjusting the size of the SB gap G. The first example embodiment illustrates an example in which the cameras 100 are each used as a unit that measures the size of the SB gap G. Alternatively, the size of the SB gap G may be measured by a sensor or a thickness gauge, instead of using the cameras 100.

The doctor blade 360, adjusted to the desired size of the SB gap G by performing the process of adjusting the size of the SB gap G as described above, is pressed with a predetermined load and bonded to the blade mounting surface 41*s*, which is coated with the adhesive A in advance. However, even if the size of the SB gap G is adjusted to the desired size by the process of adjusting the SB gap G, there is a factor that varies the size of the SB gap G when the blade mounting surface 41*s* of the developing device frame 310 and the mounted surface 360*s* of the doctor blade 360 are pressed and bonded. The factor will be described below.

As described above, the doctor blade 360 is made of a resin material and the developing device frame 310 is also made of a resin material. Thus, the mounted surface 360*s* of the doctor blade 360 and the blade mounting surface 41*s* of the developing device frame 310 are a part of a resin component. As long as each of the doctor blade 360 and the developing device frame 310 is formed with a general resin molded product accuracy, the mounted surface 360*s* of the doctor blade 360 and the blade mounting surface 41*s* of the developing device frame 310 are not necessarily substantially parallel to each other depending on a resin molding condition and a contraction condition.

Figure 16:
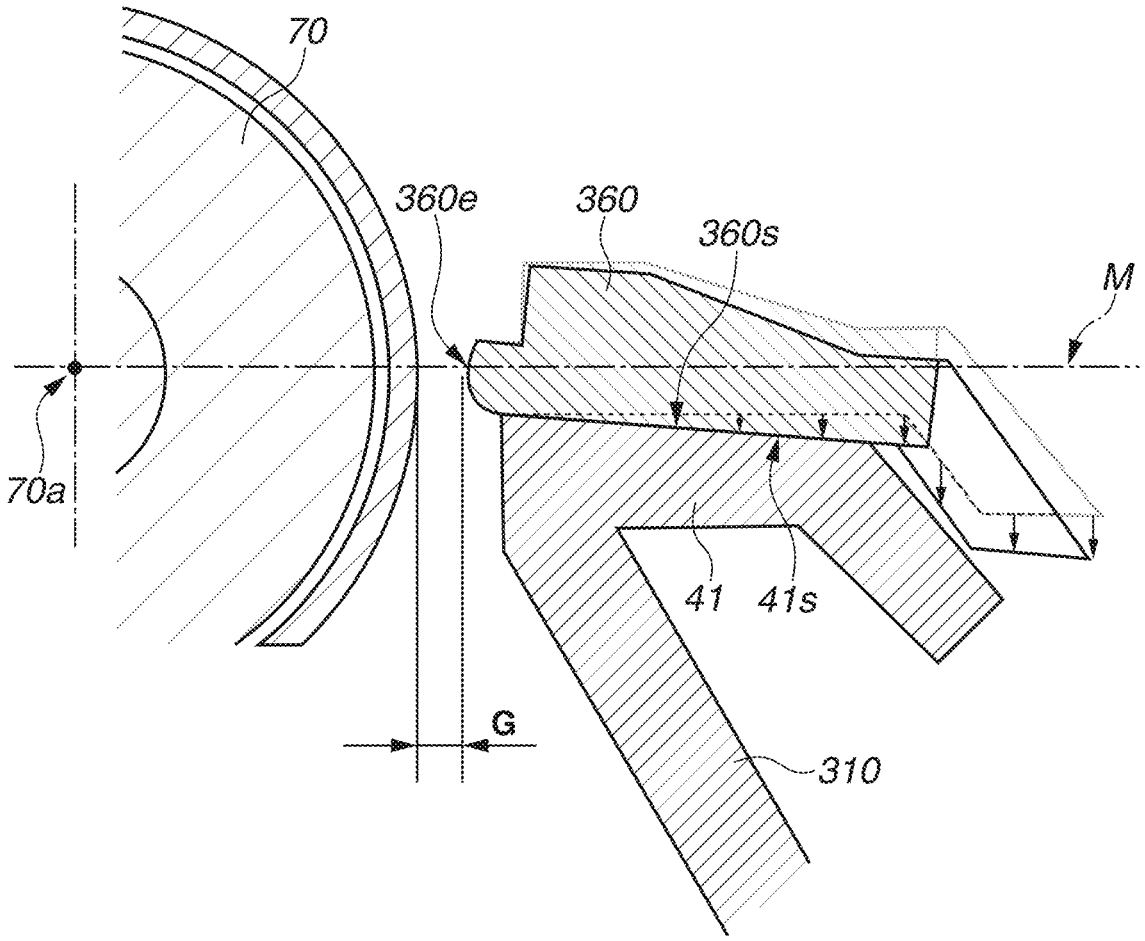
FIG. 16 is an enlarged view illustrating the orientation of the resin-made doctor blade when the doctor blade is mounted.

For example, assume that the blade mounting surface 41*s* is inclined at a predetermined angle with respect to the straight line M as illustrated in FIG. 16. In this case, the mounted surface 360*s* of the doctor blade 360 mounted on the blade mounting surface 41*s* having an inclination with respect to the straight line M is bonded to the developing device frame 310 with a predetermined inclination with respect to the straight line M along with the inclination of the blade mounting surface 41*s*. Accordingly, even if the size of the SB gap G is adjusted, the doctor blade 360 is fixed (bonded) to the blade mounting surface 41*s* with an inclination of a predetermined angle with respect to the straight line M. As a result, the orientation of the doctor blade 360 is inclined and the position of the leading end portion 360*e* of the doctor blade 360 (the position of the doctor blade 360 relative to the developing sleeve 70) varies. Further, the adjusted size of the SB gap G is different from the value of the SB gap G after bonding.

As the inclination of the blade mounting surface 41*s* with respect to the straight line M increases, a variation amount of the position of the doctor blade 360 relative to the developing sleeve 70 increases when the doctor blade 360 is mounted on the blade mounting surface 41*s*. This means that the size of the SB gap G generated when the doctor blade 360 is mounted on the blade mounting surface 41*s* varies as the inclination of the blade mounting surface 41*s* with respect to the straight line M increases. In this case, the varying size of the SB gap G is defined as "ΔG". Further, an angle of rotation of the doctor blade 360 along with the blade mounting surface 41*s* around the first grip member 101*a* when the doctor blade 360 is mounted and bonded onto the blade mounting surface 41*s* having an inclination with respect to the straight line M is defined as an "angle θ".

A relationship between the "angle θ" and "ΔG" when the doctor blade 360 is mounted on the blade mounting surface 41*s* having an inclination with respect to the straight line M will now be described with reference to FIGS. 17A and 17B.

Figure 17A:
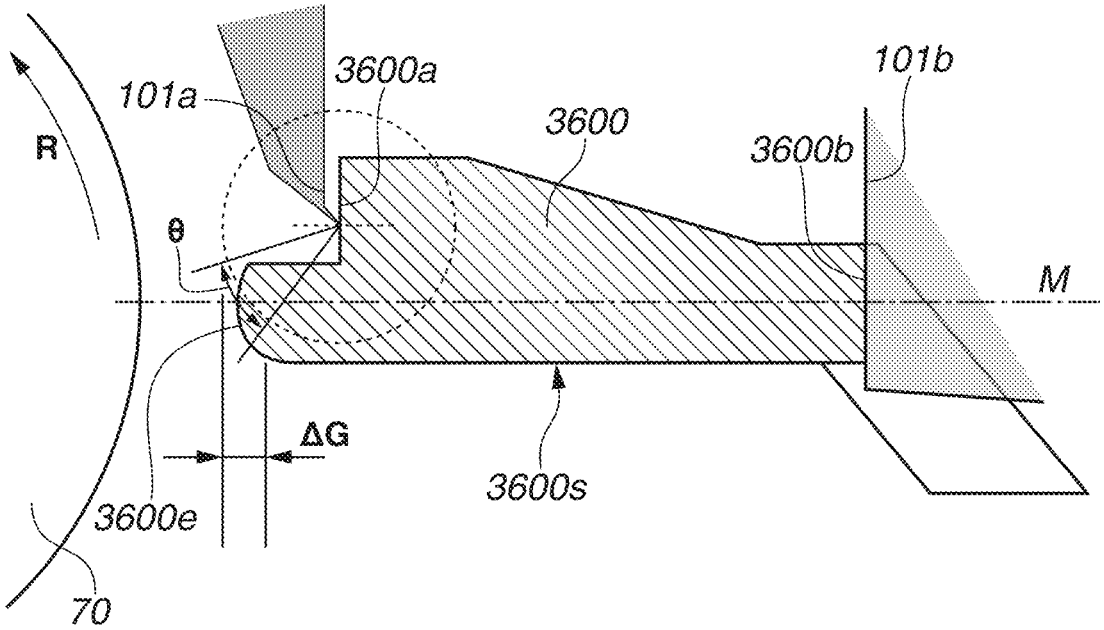
FIGS. 17A and 17B are enlarged views each illustrating the orientation of the resin-made doctor blade when the doctor blade is mounted.

FIG. 17A illustrates an example (comparative example) in which a grip position of a doctor blade 3600 to be gripped by the first grip member 101*a* is disposed at a position apart from the straight line M. On the other hand, FIG. 17B illustrates an example in which a grip position of the doctor blade 360 to be gripped by the first grip member 101*a* is disposed on the straight line M. The size of the "angle θ" illustrated in FIG. 17A is the same as the size of the "angle θ" illustrated in FIG. 17B. However, even if the size of the "angle θ" illustrated in FIG. 17A is the same as the size of the "angle θ" illustrated in FIG. 17B, "ΔG" illustrated in FIG. 17B is smaller than "ΔG" illustrated in FIG. 17A. This means that, at the same angle θ, "ΔG" with respect to the inclination of the blade mounting surface 41*s* in the structure in which the grip position of the doctor blade to be gripped by the first grip member 101*a* is disposed on the straight line M is smaller than that in the structure in which the grip position is disposed at a position apart from the straight line M.

Figure 17B:
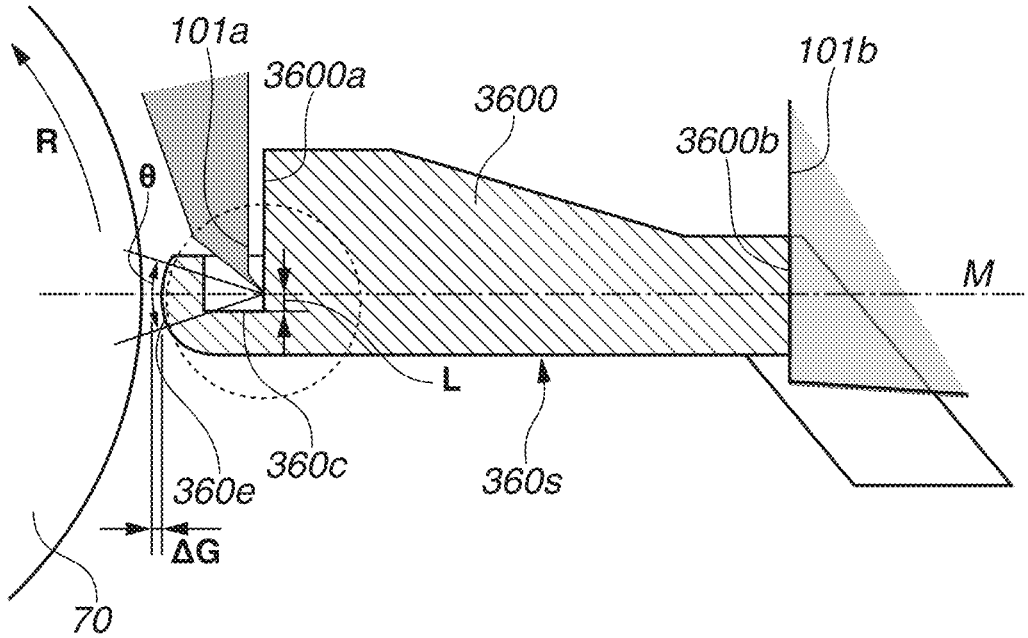

The first example embodiment has a feature that, as illustrated in FIG. 17B, a recessed portion (recessed portion 360*c*) for the first grip member 101*a* to grip the doctor blade 360 is formed on the doctor blade 360. The recessed portion 360*c* is formed on the upstream side of the doctor blade 360 with respect to the closest position (the leading end portion 360*e* of the doctor blade 360) where the doctor blade 360 comes closest to the developing sleeve 70 in a rotation direction R of the developing sleeve 70. Further, a plurality of recessed portions 360*c* of the doctor blade 360 is formed at intervals in the rotational axis direction (the longitudinal direction of the doctor blade 360) of the developing sleeve 70. The reason that the recessed portions 360*c* are formed on the doctor blade 360 will now be described below.

Regardless of the flatness of the blade mounting surface 41*s*, when the doctor blade 360 is mounted on the blade mounting surface 41*s*, a variation in the position where the doctor blade 360 comes closest to the developing sleeve 70 is prevented. To prevent the variation, the grip position of the doctor blade 360 to be gripped by the first grip member 101*a* and the grip position of the doctor blade 360 to be gripped by the second grip member 101*b* are disposed on the straight line M.

Accordingly, a position of the doctor blade 360 on the straight line M is used as a target of the grip position of the doctor blade 360 to be gripped by the first grip member 101*a*. However, there is a possibility that the first grip member 101*a* may grip a position away from the position of the doctor blade 360 on the straight line M by a predetermined distance due to a positional accuracy of the first grip member 101*a*. For this reason, the shape of the doctor blade 360 may have to be designed in consideration of the positional accuracy of the first grip member 101*a* when the grip position of the doctor blade 360 to be gripped by the first grip member 101*a* is disposed on the straight line M of the doctor blade 360.

Therefore, as illustrated in FIG. 17B, the recessed portion 360*c* is formed on the doctor blade 360 and a length L of a predetermined region of the recessed portion 360*c* is set. The length L of the predetermined region of the recessed portion 360*c* indicates a vertical direction length that is vertical to the straight line M at a portion on the upstream side of the doctor blade 360 with respect to the position where the doctor blade 360 comes closest to the developing sleeve 70 in the rotation direction R of the developing sleeve 70 in the recessed portion 360*c*. When the recessed portion 360*c* of the doctor blade 360 is gripped by the first grip member 101*a*, a mark is formed on the recessed portion 360*c* after being gripped by the first grip member 101*a*. The mark formed after gripping can be recognized by conducting an analysis using a three-dimensional measuring instrument. Accordingly, it can be verified that the first grip member 101*a* has gripped the recessed portion 360*c* in the case of gripping the doctor blade 360.

In the first example embodiment, a lower limit of the length L of the predetermined region of each recessed portion 360*c* provided on the doctor blade 360 is set to 0.5 mm in consideration that a minimum value of a thickness of a resin molded product in resin molding is locally 0.5 mm. In other words, in the first example embodiment, the length L of the predetermined region of each recessed portion 360*c* is 0.5 mm or more.

Further, the lower limit of the length L of the predetermined region of each recessed portion 360*c* formed on the doctor blade 360 is desirably set as follows, as needed. Specifically, depending on the inclination of the blade mounting surface 41*s* with respect to the installation surface (horizontal surface) of the blade mounting device, an allowable size that satisfies the positional accuracy of the first grip member 101*a* when the grip position of the doctor blade 360 to be gripped by the first grip member 101*a* is disposed on the straight line M is taken into consideration. In addition, depending on a size allowed as a deviation in adjustment of the SB gap G, an allowable size that satisfies the positional accuracy of the first grip member 101*a* when the grip position of the doctor blade 360 to be gripped by the first grip member 101*a* is disposed on the straight line M is taken into consideration.

For example, assume that the angle of the inclination of the blade mounting surface 41*s* with respect to the installation surface (horizontal surface) of the blade mounting device is ±5 degrees and the size allowed as a deviation in adjustment of the SB gap G is ±10 μm. In this case, ±0.3 mm is allowed as the positional accuracy of the first grip member 101*a* when the grip position of the doctor blade 360 to be gripped by the first grip member 101*a* is disposed on the straight line M. Thus, a position at a distance of 0.3 mm on the upstream side of the doctor blade 360 with respect to the closest position where the doctor blade 360 comes closest to the developing sleeve 70 in the rotation direction R of the developing sleeve 70 is set as a start point. A position at a distance of 0.3 mm on the downstream side of the doctor blade 360 with respect to the closest position where the doctor blade 360 comes closest to the developing sleeve 70 in the rotation direction R of the developing sleeve 70 is set as an end point. In the range from the start point to the end point in the rotation direction R of the developing sleeve 70, the first grip member 101*a* is allowed to grip the doctor blade 360. In other words, the first grip member 101*a* may have to grip the doctor blade 360 on the position at a distance of 0.3 mm on the upstream side of the doctor blade 360 with respect to the closest position where the doctor blade 360 comes closest to the developing sleeve 70 in the rotation direction R of the developing sleeve 70. To this end, the length L of the predetermined region of each recessed portion 360*c* is desirably set to 0.6 mm or more in consideration of a thickness balance margin (±0.3 mm) in resin molding.

For example, assume that the angle of the inclination of the blade mounting surface 41*s* with respect to the installation surface (horizontal surface) of the blade mounting device is ±8 degrees and a size allowed as a deviation in adjustment of the SB gap G is ±30 μm. In this case, ±0.5 mm is allowed as the positional accuracy of the first grip member 101*a* when the grip position of the doctor blade 360 to be gripped by the first grip member 101*a* is disposed on the straight line M. In other words, a position at a distance of 0.5 mm on the upstream side of the doctor blade 360 with respect to the closest position where the doctor blade 360 comes closest to the developing sleeve 70 in the rotation direction R of the developing sleeve 70 is set as a start point. A position at a distance of 0.5 mm on the downstream side of the doctor blade 360 with respect to the closest position where the doctor blade 360 comes closest to the developing sleeve 70 in the rotation direction R of the developing sleeve 70 is set as an end point. In the range from the start point to the end point in the rotation direction R of the eloping sleeve 70, the first grip member 101*a* is allowed to grip the doctor blade 360. In other words, the first grip member 101*a* may need to grip the doctor blade 360 on the position at a distance of 0.5 mm on the upstream side of the doctor blade 360 with respect to the closest position where the doctor blade 360 comes closest to the developing sleeve 70 in the rotation direction R of the developing sleeve 70. To this end, the length L of the predetermined region of each recessed portion 360*c* is desirably set to 0.8 mm or more in consideration of a thickness balance margin (±0.3 mm) in resin molding.

As described above, in the first example embodiment, the doctor blade 360 is flexed to correct the straightness of the doctor blade 360. Accordingly, the length of a basic thickness of the doctor blade 369 is set in a range from 1.0 mm to 3.0 mm to reduce the rigidity of the doctor blade 360 (alone) so that the doctor blade 360 can be flexed. In consideration of this, an upper limit of the length L of the predetermined region of each recessed portion 360*c* of the doctor blade 360 is desirably set to be shorter than the length of the basic thickness of the doctor blade 360 and is desirably set to 1.0 mm or less.

In this manner, the length L of the predetermined region of each recessed portion 360*c* of the doctor blade 360 is designed in consideration of the allowance of the positional accuracy of the first grip member 101*a* when the grip position of the doctor blade 360 to be gripped by the first grip member 101*a* is disposed on the straight line M of the doctor blade 360. The allowance of the positional accuracy of the first grip member 101*a* is determined based on the angle of the inclination of the blade mounting surface 41*s* with respect to the installation surface (horizontal surface) of the blade mounting device and the size allowed as a deviation in adjustment of the SB gap G.

In the first example embodiment, as described above with reference to FIG. 17B, a position of the doctor blade 360 on the straight line M is used as a target of the grip position of the doctor blade 360 to be gripped by the first grip member 101*a*. Further, in the first example embodiment, the doctor blade 360 is provided with the recessed portions 360*c* described above with reference to FIG. 17B. Furthermore, in the first example embodiment, in consideration of the positional accuracy of the first grip member 101*a*, the first grip member 101*a* can grip a position away from the position of the doctor blade 360 on the straight line M by the predetermined distance on the upstream side in the rotation direction R of the developing sleeve 70.

Thus, it is possible to prevent a variation in the position of the regulating blade relative to the developing sleeve, including the position where the regulating blade comes closest to the developing sleeve, when the regulating blade is mounted on the blade mounting surface, regardless of the flatness of the blade mounting surface of the developing device frame. According to the first example embodiment as described above, it is possible to prevent a variation in the position where the resin-made regulating blade comes closest to the developer bearing member when the regulating blade is mounted on the resin-made developing device frame, and it is also possible to set the SB gap to fall within a predetermined range in the longitudinal direction of the developer bearing member.

In the first example embodiment descried above, an example is described where the blade mounting surface 41*s* has an inclination with respect to the installation surface (horizontal surface) of the blade mounting device when the regulating blade is mounted on the blade mounting surface. However, it is not limited thereto. The present disclosure is also applicable to a case where, when the regulating blade is mounted on the blade mounting surface, not only the blade mounting surface 41*s*, but also the mounted surface 360*s* of the doctor blade 360 has an inclination with respect to the installation surface (horizontal surface) of the blade mounting device. In this case, even if a deviation occurs in a relative surface accuracy between the mounted surface 360*s* of the doctor blade 360 and the blade mounting surface 41*s*, ΔG (the variation amount of the position of the doctor blade 360 relative to the developing sleeve 70) can be reduced.

OTHER EXAMPLE EMBODIMENTS

The present disclosure is not limited to the example embodiments described above. Various modifications (including any organic combination of example embodiments) can be made based on the gist of the present disclosure, and these modifications are within the scope of the present disclosure.

In the example embodiments described above, an example is described where, as illustrated in FIG. 1, the image forming apparatus 60 has a structure in which the intermediate transfer belt 61 is used as the intermediate transfer member. However, it is not limited thereto. The present disclosure is also applicable to an image forming apparatus having a structure in which recording materials are sequentially brought into direct contact with the photosensitive drum 1.

Further, in the example embodiments described above, an example is described where the developing device 300 is configured as a single unit. However, advantageous effects similar to those described above can be obtained also in the form of a process cartridge in which the image forming unit 600 (see FIG. 1) including the developing device 300 are integrated into a unit and the unit is configured to be attachable to and detachable from the image forming apparatus 60. The present disclosure is also applicable to any types of image forming apparatus, such as a monochrome or color image forming apparatus, as long as the image forming apparatus functions as the image forming apparatus 60 including the developing device 300 or the process cartridge.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2018-220915, filed Nov. 27, 2018, which is hereby incorporated by reference herein in its entirety.

What is claimed is:

1. A developing device comprising:

a rotatable developing member configured to bear and feed a developer including toner and carrier toward a position where an electrostatic image formed on an image bearing member is developed;

a resin-made regulating blade provided opposing the rotatable developing member and configured to regulate an amount of the developer born on the rotatable developing member; and a resin-made developing device frame provided separately from the regulating blade and including a mounting portion to mount the regulating blade, wherein a recessed portion for gripping the regulating blade is formed, when the developing device is viewed in a section perpendicular to a rotational axis of the rotatable developing member, on an upstream side of the regulating blade with respect to a closest position where the regulating blade is closest to the rotatable developing member in a rotation direction of the rotatable developing member, and wherein a length of the recessed portion in a direction vertical to a straight line passing through the closest position and a rotation center of the rotatable developing member is 0.5 mm or more.

2. The developing device according to claim 1, wherein the length of the recessed portion in the vertical direction when the developing device is viewed in the section perpendicular to the rotation axis of the rotatable developing member is 0.6 mm or more.

3. The developing device according to claim 1, wherein the length of the recessed portion in the vertical direction when the developing device is viewed in the section perpendicular to the rotational axis of the rotatable developing member is 0.8 mm or more.

4. The developing device according to claim 1, wherein the length of the recessed portion in the vertical direction when the developing device is viewed in the section perpendicular to the rotational axis of the rotatable developing member is 1.0 mm or less.

5. The developing device according to claim 1, wherein a thickness of the regulating blade is in a range from 1.0 mm to 3.0 mm, and wherein the length of the recessed portion in the vertical direction when the developing device is viewed in the section perpendicular to the rotational axis of the rotatable developing member is less than the thickness of the regulating blade.

6. The developing device according to claim 1, wherein the regulating blade is provided with a plurality of the recessed portions at intervals in the rotational axis direction of the rotatable developing member.

7. The developing device according to claim 1, wherein the regulating blade is fixed to the mounting portion in a state where the regulating blade is flexed with a gap between the rotatable developing member and the regulating blade being within a predetermined range over an entire region of the regulating blade corresponding to a maximum image region in which an image is formable on the image bearing member.

8. The developing device according to claim 7, wherein let $g_1$ be the gap at a first portion of the region of the regulating blade corresponding to a maximum image region of the image bearing member, let $g_2$ be the gap at a second portion of the region of the regulating blade corresponding to the maximum image region of the image bearing member, let $g_3$ be the gap at a third portion of the region of the regulating blade corresponding to the maximum image region of the image bearing member, let $g_{target}$ be a target value of the gap, when definition of $g_1$, $g_2$, $g_3$, and $g_{target}$ shown above is given, by satisfying formulae shown below, the gap is within the predetermined range over the entire region of the regulating blade corresponding to the maximum image region of the image bearing member, $$0.9\times g_1 \leq g_{target} \leq 1.1\times g_1,$$

$$0.9\times g_2 \leq g_{target} \leq 1.1\times g_2, \text{ and}$$

$$0.9\times g_3 \leq g_{target} \leq 1.1\times g_3,$$

9. The developing device according to claim 1, wherein the regulating blade is fixed to the mounting portion with an adhesive over substantially an entire region of the regulating blade corresponding to a maximum image region in which an image is formable on the image bearing member.

10. The developing device according to claim 1, wherein the regulating blade has a rigidity capable of being flexed.

* * * * *